US011326120B2

(12) United States Patent
Oki

(10) Patent No.: US 11,326,120 B2
(45) Date of Patent: May 10, 2022

(54) LUBRICATING OIL COMPOSITION, INTERNAL COMBUSTION ENGINE, AND LUBRICATION METHOD FOR INTERNAL COMBUSTION ENGINE

(71) Applicant: IDEMITSU KOSAN CO., LTD., Chiyoda-ku (JP)

(72) Inventor: Hiroshi Oki, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/634,216

(22) PCT Filed: Aug. 3, 2018

(86) PCT No.: PCT/JP2018/029205
§ 371 (c)(1),
(2) Date: Jan. 27, 2020

(87) PCT Pub. No.: WO2019/031404
PCT Pub. Date: Feb. 14, 2019

(65) Prior Publication Data

US 2020/0339903 A1 Oct. 29, 2020

(30) Foreign Application Priority Data

Aug. 10, 2017 (JP) ..... JP2017-155733

(51) Int. Cl.
*C10M 107/10* (2006.01)
*C10M 101/00* (2006.01)
(Continued)

(52) U.S. Cl.
CPC ..... *C10M 107/10* (2013.01); *C10M 101/00* (2013.01); *C10M 105/18* (2013.01);
(Continued)

(58) Field of Classification Search
CPC ..... C10M 107/10; C10M 101/00; C10M 105/18; C10M 135/18; C10M 145/14;
(Continued)

(56) References Cited

U.S. PATENT DOCUMENTS 11,041,132 B2 * 6/2021 Oki ..... C10M 161/00
2003/0055184 A1 * 3/2003 Song ..... C10M 143/08 526/160
(Continued)

FOREIGN PATENT DOCUMENTS

CN 102395664 A 3/2012
CN 104508098 A 4/2015
(Continued)

OTHER PUBLICATIONS

International Search Report dated Nov. 6, 2018 in PCT/JP2018/029205 filed on Aug. 3, 2018, 2 pages.
(Continued)

*Primary Examiner* — Ellen M McAvoy
(74) *Attorney, Agent, or Firm* — Oblon, McClelland, Maier & Neustadt, L.L.P.

(57) ABSTRACT

The present invention relates to a lubricating oil composition containing a base oil (A) containing an olefin-based polymer (A1) having an area ratio of a peak derived from a hydride (A11) of a decene trimer of 80% or more relative to 100% of a total area of peaks derived from the olefin-based polymer (A1) detected in a chromatogram and having predetermined kinematic viscosity, flash point, and pour point, a viscosity index improver (B) containing a comb-shaped polymer (B1), and an organic molybdenum-based compound (C), in which the content of the comb-shaped polymer (B1) is regulated within a specified range and having a HTHS viscosity at each of 150° C. and 50° C. of the
(Continued)

lubricating oil composition and a NOACK value in predetermined ranges, respectively.

18 Claims, 4 Drawing Sheets

(51) Int. Cl.

| | |
|---|---|
| ***C10M 105/18*** | (2006.01) |
| ***C10M 135/18*** | (2006.01) |
| ***C10M 145/14*** | (2006.01) |
| ***C10M 169/04*** | (2006.01) |
| *C10N 20/00* | (2006.01) |
| *C10N 30/00* | (2006.01) |
| *C10N 10/12* | (2006.01) |
| *C10N 20/02* | (2006.01) |
| *C10N 20/04* | (2006.01) |
| *C10N 30/02* | (2006.01) |
| *C10N 40/25* | (2006.01) |

(52) U.S. Cl.
CPC ..... *C10M 135/18* (2013.01); *C10M 145/14* (2013.01); *C10M 169/044* (2013.01); *C10M 2205/022* (2013.01); *C10M 2205/024* (2013.01); *C10M 2205/0285* (2013.01); *C10M 2205/04* (2013.01); *C10M 2205/06* (2013.01); *C10M 2207/0406* (2013.01); *C10M 2209/084* (2013.01); *C10M 2219/068* (2013.01); *C10M 2223/045* (2013.01); *C10N 2010/12* (2013.01); *C10N 2020/02* (2013.01); *C10N 2020/04* (2013.01); *C10N 2020/071* (2020.05); *C10N 2030/02* (2013.01); *C10N 2030/54* (2020.05); *C10N 2030/74* (2020.05); *C10N 2040/25* (2013.01)

(58) Field of Classification Search
CPC ..... C10M 169/044; C10M 2205/022; C10M 2205/024; C10M 2205/0285; C10M 2205/04; C10M 2205/06; C10M 2207/0406; C10M 2209/084; C10N 2020/071; C10N 2030/74; C10N 2030/54; C10N 2020/02
See application file for complete search history.

(56) References Cited

U.S. PATENT DOCUMENTS

| | | | | |
|---|---|---|---|---|
| 2007/0225180 | A1 | 9/2007 | Tamoto | |
| 2009/0181872 | A1* | 7/2009 | Yamada | C10M 105/04 508/591 |
| 2011/0039743 | A1* | 2/2011 | Bagheri | C10M 107/10 508/591 |
| 2013/0090278 | A1* | 4/2013 | Martin | C10M 171/02 508/591 |
| 2013/0109604 | A1 | 5/2013 | Patil et al. | |
| 2013/0196888 | A1 | 8/2013 | Truong-Dinh | |
| 2015/0005208 | A1 | 1/2015 | Yaguchi et al. | |
| 2017/0137732 | A1 | 5/2017 | Utaka | |
| 2017/0226441 | A1* | 8/2017 | Courtiade | C10M 107/10 |
| 2017/0298287 | A1* | 10/2017 | Tamura | C10M 139/00 |
| 2018/0072962 | A1* | 3/2018 | Wada | C10M 145/14 |
| 2018/0163150 | A1* | 6/2018 | Lamb | C07C 43/04 |
| 2018/0258365 | A1* | 9/2018 | Ohkubo | C10M 169/048 |
| 2018/0355272 | A1* | 12/2018 | Onodera | C10M 135/18 |
| 2019/0203148 | A1* | 7/2019 | Scholler | C10M 169/041 |
| 2019/0270948 | A1* | 9/2019 | Ueda | C10M 169/041 |
| 2019/0330552 | A1* | 10/2019 | Sumi | C10M 169/04 |
| 2020/0010774 | A1* | 1/2020 | Oki | C10M 169/048 |
| 2020/0080018 | A1* | 3/2020 | Matsuda | C10M 109/00 |
| 2020/0181529 | A1* | 6/2020 | Suzuki | C10M 169/045 |

FOREIGN PATENT DOCUMENTS

| | | | |
|---|---|---|---|
| CN | 106414680 | A | 2/2017 |
| CN | 106459821 | A | 2/2017 |
| EP | 2 164 885 | A1 | 3/2010 |
| EP | 3 196 279 | A1 | 7/2017 |
| JP | 2005-344017 | A | 12/2005 |
| JP | 2007-137952 | A | 6/2007 |
| JP | 2012-57175 | A | 3/2012 |
| JP | 2013-159734 | A | 8/2013 |
| JP | 2013-536293 | A | 9/2013 |
| JP | 2017-115100 | A | 6/2017 |
| WO | WO 2016/043334 | A1 | 3/2016 |
| WO | 2016/129465 | A1 | 8/2016 |
| WO | WO 2016/159006 | A1 | 10/2016 |
| WO | WO 2016/203310 | A1 | 12/2016 |

OTHER PUBLICATIONS

Extended European Search Report dated Apr. 20, 2021 in corresponding European Patent Application No. 18845166.0, 8 pages.
James A. Brennan, "Wide-Temperature Range Synthetic Hydrocarbon Fluids", Ind. Eng. Chem. Prod. Res., vol. 19, Dec. 31, 1980, pp. 2-6.
Office Action dated Oct. 20, 2021, in Chinese Patent Application No. 20180050539.4 filed Aug. 3, 2018 (with English translation).
Wang, S. et al., "Study on 1-decene catalyzed to poly-alpha-olefins synthetic lubricant base oil by boron trifuoride", Chemical Industry and Engineering Progress, vol. 35, No. 12, pp. 3907-3912 (2016).
Office Action dated Mar. 1, 2022, in Japanese Patent Application No. 2019-535173 filed Aug. 3, 2018 (with computer generated English translation).

* cited by examiner

LUBRICATING OIL COMPOSITION, INTERNAL COMBUSTION ENGINE, AND LUBRICATION METHOD FOR INTERNAL COMBUSTION ENGINE

TECHNICAL FIELD

The present invention relates to a lubricating oil composition, an internal combustion engine using the lubricating oil composition, and a method for lubricating an internal combustion engine with the lubricating oil composition.

BACKGROUND ART

In recent years, from the viewpoints of reducing an energy loss and reducing the generation amount of carbon dioxide, fuel consumption reducing properties are required, and an improvement of fuel consumption reducing performance is also required for engine oils to be used for vehicles.

As general means for reducing fuel consumption of an engine oil, there are exemplified a method of performing preparation such that not only a kinematic viscosity of the engine oil is reduced, but also a viscosity index in the engine oil is improved; and a method of adding a friction modifier, such as an organic molybdenum compound, in the engine oil, to contemplate to reduce friction under mixed lubricating conditions.

Taking into consideration these two methods, development of an engine oil with improved fuel consumption is being performed.

For example, PTL 1 describes a lubricating oil composition for internal combustion engine containing a base oil having a kinematic viscosity at 100° C. of 2 to 8 $mm^2/s$ and an aromatic content of 10% by mass or less, a metallic detergent having a metal ratio of 1.01 to 3.3 and overbased with an alkaline earth metal borate, and an organic molybdenum compound in a predetermined amount; and having a high temperature high shear viscosity (HTHS viscosity) at 100° C. of 5.5 mPa·s or less.

According to the description of PTL 1, the aforementioned lubricating oil composition for internal combustion engine is made low in viscosity and reveals excellent fuel consumption reducing properties while reducing friction under mixed lubricating conditions.

CITATION LIST

Patent Literature

PTL 1: JP 2013-159734 A

SUMMARY OF INVENTION

Technical Problem

Now, in recent years, development of a hybrid car represented by HEV (hybrid electric vehicle) provided with, as a power source, an internal combustion engine (engine) and an electric motor (motor) is being advanced.

An engine oil which is used for the hybrid car is heated and becomes high in temperature at the time of engine start; but at the time of motor operation, the engine is stopped or becomes low in speed, and the engine oil becomes low in temperature as about 50° C. In view of the fact that a practical use temperature area of an engine oil which is used for an engine to be mounted in a general vehicle is about 80° C., the temperature area of the engine oil at the time of engine operation of the hybrid car is considerably low in temperature.

Here, in the case where an engine oil which is used for an engine to be mounted in a general vehicle is used for a hybrid car, the engine oil becomes low in temperature as about 50° C. at the time of motor operation. Accordingly, the engine oil becomes high in viscosity, possibly resulting in a lowering of fuel consumption reducing properties.

In order to solve the aforementioned problem, it may be considered to use a low-viscosity base oil as the engine oil of a hybrid car.

However, in general, an engine oil using a low-viscosity base oil is high in evaporativity. Accordingly, when operating the engine at high speed, the evaporation of the engine oil becomes large due to an increase of thermal load of the engine, the amount of oil needed for lubrication cannot be thoroughly kept, and breakage of an engine part is possibly caused.

In addition, when operating the engine at high speed, the engine oil becomes high in temperature. When the engine oil becomes high in temperature, there is a tendency that a lowering of viscosity is caused, it becomes difficult to retain an oil film, and an increase of a coefficient of friction is caused.

In addition to the above, in general, in an engine oil using a low-viscosity base oil, even when blending an organic molybdenum-based compound that is a friction modifier, there is a tendency that a friction reducing effect is not thoroughly revealed.

Accordingly, on heating an engine oil to about 80° C. that is the practical use temperature area of the engine oil, the oil film cannot be retained, possibly resulting in a harmful effect such that the coefficient of friction increases.

An object of the present invention is to provide a lubricating oil composition which when used in both a high-temperature environment at around 150° C. and a low-temperature environment at around 50° C., exhibits excellent fuel consumption reducing properties and also has a high friction reducing effect, while achieving low evaporativity, an internal combustion engine using the lubricating oil composition, and a method for lubricating an internal combustion engine with the lubricating oil composition.

Solution to Problem

The present inventor has found that a lubricating oil composition containing a comb-shaped polymer and an organic molybdenum-based compound in predetermined amounts together with an olefin-based polymer satisfying specified requirements is able to solve the aforementioned problem.

Specifically, the present invention provides the following [1] to [3].

[1] A lubricating oil composition containing a base oil (A) containing an olefin-based polymer (A1), a viscosity index improver (B) containing a comb-shaped polymer (B1), and an organic molybdenum-based compound (C), wherein, the olefin-based polymer (A1) satisfies the following requirements (a1) to (a5):

Requirement (a1): An area ratio of a peak derived from a hydride (A11) of a decene trimer is 80% or more relative to 100% of a total area of peaks derived from the olefin-based polymer (A1) detected in a chromatogram on performing chromatography analysis, Requirement (a2): A kinematic viscosity at 40° C. is 16.0 $mm^2/s$ or less, Requirement (a3): A kinematic viscosity at 100° C. is from 3.0 to 4.0 $mm^2/s$, Requirement (a4): A flash point is 220° C. or higher, and Requirement (a5): A pour point is −30° C. or lower;

the content of the comb-shaped polymer (B1) is 0.30% by mass or more on the basis of the whole amount of the lubricating oil composition; and the lubricating oil composition satisfies the following requirements (I) to (III):

Requirement (I): A HTHS Viscosity ($H_{150}$) at 150° C. is 1.5 mPa·s or more,

Requirement (II): A HTHS viscosity ($H_{50}$) at 50° C. is less than 12.3 mPa·s, and Requirement (III): A NOACK value is 15.0% by mass or less.

[2] An internal combustion engine including a sliding mechanism equipped with a piston ring and a liner, and the lubricating oil composition as set forth in the above [1].

[3] A method for lubricating an internal combustion engine having a sliding mechanism equipped with a piston ring and a liner, the method including lubricating the piston ring and the liner with the lubricating oil composition as set forth in the above [1].

Advantageous Effects of Invention

When used in both a high-temperature environment at around 150° C. and a low-temperature environment at around 50° C., the lubricating oil composition of the present invention exhibits excellent fuel consumption reducing properties and also has a high friction reducing effect, while achieving low evaporativity.

DESCRIPTION OF EMBODIMENTS

Figure 1:
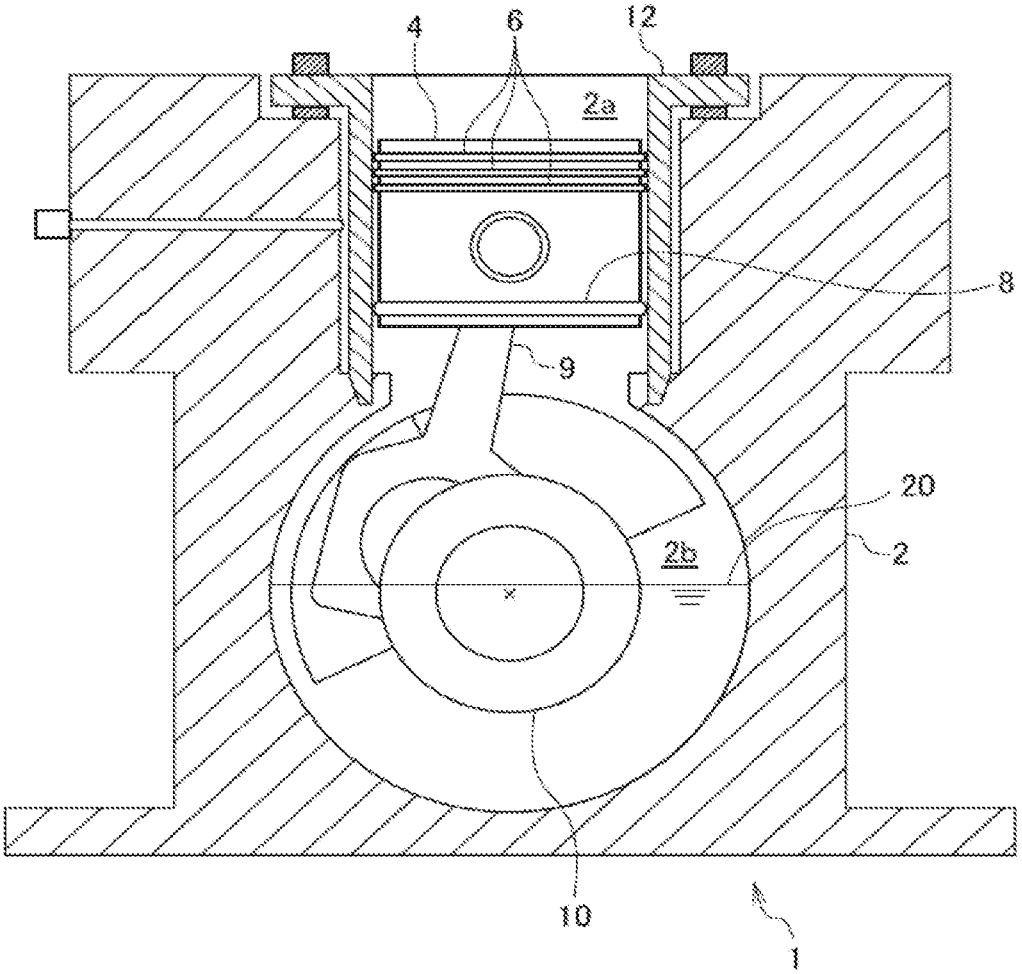
FIG. 1 is a schematic view illustrating an outline of a configuration of a sliding mechanism equipped with a piston ring and a liner.

In this specification, the values of kinetic viscosity at each of 40° C., 50° C., and 100° C. and viscosity index are values measured in conformity with JIS K2283:2000.

In this specification, the values of the mass average molecular weight (Mw) and the number average molecular weight (Mn) of each of the components are each a value in terms of standard polystyrene measured by the gel permeation chromatography (GPC), and specifically, a value measured according to the method described in the section of Examples.

In this specification, for example, the "alkyl(meth)acrylate" is used as a terminology expressing both an "alkylacrylate" and an "alkylmethacrylate", and other analogous terms or similar expressions are also the same.

[Lubricating Oil Composition]

The lubricating oil composition of the present invention is one containing a base oil (A) containing an olefin-based polymer (A1), a viscosity index improver (B) containing a comb-shaped polymer (B1), and an organic molybdenum-based compound (C), and satisfying the following requirements (I) to (III):

Requirement (I): A HTHS viscosity ($H_{150}$) at 150° C. is 1.5 mPa·s or more,

Requirement (II): A HTHS viscosity ($H_{50}$) at 50° C. is less than 12.3 mPa·s, and Requirement (III): A NOACK value is 15.0% by mass or less.

In the case where the lubricating oil composition of the present invention contains the olefin-based polymer (A1) satisfying the specified requirements as the base oil (A) as well as the comb-shaped polymer (B1) as the viscosity index improver (B), the lubricating oil composition is prepared so as to satisfy the aforementioned requirements (I) to (III).

The HTHS viscosity ($H_{150}$) as prescribed in the requirement (I) exhibits viscosity of the lubricating oil composition in a high-temperature area when operating the engine at high speed and may be said to be an index of retaining performance of an oil film in a high-temperature area.

In the case where the olefin-based polymer (A1) and the comb-shaped polymer are combined and used, the lubricating oil composition of the present invention is able to keep an appropriate viscosity to an extent of satisfying the requirement (I) in a high-temperature environment and to retain an oil film. In consequence, the lubricating oil composition of the present invention is able to contribute to an improvement of fuel consumption reducing properties in a high-temperature area.

In the lubricating oil composition of the present invention, as prescribed in the requirement (I), though the HTHS viscosity ($H_{150}$) at 150° C. is 1.5 mPa·s or more, it is preferably 1.55 mPa·s or more, more preferably 1.6 mPa·s or more, still more preferably 1.65 mPa·s or more, and yet still more preferably 1.7 mPa·s or more.

In the lubricating oil composition according to one embodiment of the present invention, the HTHS viscosity ($H_{150}$) at 150° C. is preferably 3.2 mPa·s or less, more preferably 3.0 mPa·s or less, still more preferably 2.8 mPa·s or less, and yet still more preferably 2.6 mPa·s or less.

The HTHS viscosity ($H_{50}$) as prescribed in the requirement (II) is one prescribing the viscosity of the lubricating oil composition when the engine mounted in, for example, a hybrid car has stopped or become low in speed to become low in temperature as about 50° C.

The lubricating oil composition of the present invention contains, as the base oil (A), the olefin-based polymer (A1) satisfying the specified requirements and also contains, as the viscosity index improver (B), the comb-shaped polymer (B1). Accordingly, when used as an engine oil of the hybrid car, even in a low-temperature area at around 50° C., the viscosity can be decreased to an extent prescribed in the requirement (II). As a result, the lubricating oil composition of the present invention has excellent fuel consumption reducing properties in a low-temperature area.

In the lubricating oil composition of the present invention, as prescribed in the requirement (II), though the HTHS viscosity ($H_{50}$) at 50° C. is less than 12.3 mPa·s, it is preferably 12.1 mPa·s or less, more preferably 11.7 mPa·s or less, still more preferably 11.4 mPa·s or less, and yet still more preferably 10.8 mPa·s or less.

In the lubricating oil composition according to one embodiment of the present invention, the HTHS viscosity ($H_{50}$) at 50° C. is preferably 7.0 mPa·s or more, more preferably 7.5 mPa·s or more, still more preferably 8.0 mPa·s or more, and yet still more preferably 8.5 mPa·s or more.

In this specification, the HTHS viscosity means a value measured in conformity with ASTM D4741.

Furthermore, the lubricating oil composition of the present invention is prepared in such a manner that the NOACK value is 15.0% by mass or less so as to satisfy the aforementioned requirement (III), while being made low in viscosity so as to the aforementioned requirement (II), thereby achieving low evaporativity.

When the NOACK value of the lubricating oil composition is more than 15.0% by mass, when operating the engine at high speed, the evaporation becomes large due to an increase of thermal load of the engine, the amount of oil needed for lubrication cannot be thoroughly kept, and breakage of an engine part is possibility caused.

From the viewpoint of suppressing the aforementioned harmful effect, the NOACK value of the lubricating oil composition according to one embodiment of the present invention is preferably 14.8% by mass or less, more preferably 14.6% by mass or less, and still more preferably 14.5% by mass or less, and it is preferably 1% by mass or more, more preferably 3% by mass or more, and still more preferably 5% by mass or more.

In this specification, the NOACK value means a value measured in conformity with JPI-5S-41-2004.

Although the lubricating oil composition of the present invention is one containing the base oil (A) containing the olefin-based polymer (A1), the viscosity index improver (B) containing the comb-shaped polymer (B1), and the organic molybdenum-based compound (C), it may further contain other additive for lubricating oil than those mentioned above, as long as the requirements (I) to (III) are satisfied and the effects of the present invention are not impaired.

In the lubricating oil composition according to one embodiment of the present invention, the total content of the components (A), (B), and (C) is preferably 60 to 100% by mass, more preferably 70 to 100% by mass, still more preferably 80 to 100% by mass, and yet still more preferably 85 to 100% by mass on the basis of the whole amount (100% by mass) of the lubricating oil composition.

Here, by appropriately selecting and setting the kinds and contents of the components (A) to (C), and the like, the lubricating oil composition of the present invention is one prepared so as to satisfy the requirements (I) to (III).

From the viewpoint of performing the preparation so as to satisfy the requirements (I) to (III), preferred embodiments of the respective components of the lubricating oil composition of the present invention are hereunder described.

<Base Oil (A)>

Although the base oil (A) which is contained in the lubricating oil composition of the present invention contains the olefin-based polymer (A1), it may also contain other base oil which is not corresponding to the olefin-based polymer (A1).

Among such other base oils, in the lubricating oil composition according to one embodiment of the present invention, it is preferred that the base oil (A) further contains an ether compound (A2) represented by the following general formula (1).

$$R^1—O—R^2 \quad (1)$$

In the general formula (1), $R^1$ and $R^2$ each independently represent an alkyl group having 6 to 22 carbon atoms, and preferably 8 to 20 carbon atoms.

The content of the component (A1) in the whole amount (100% by mass) of the base oil (A) which is contained in the lubricating oil composition according to one embodiment of the present invention is preferably 10 to 100% by mass, more preferably 15 to 100% by mass, still more preferably 20 to 98% by mass, and yet still more preferably 25 to 97% by mass.

The total content of the components (A1) and (A2) in the whole amount (100% by mass) of the base oil (A) which is contained in the lubricating oil composition according to one embodiment of the present invention is preferably 60 to 100% by mass, more preferably 70 to 100% by mass, still more preferably 80 to 100% by mass, and yet still more preferably 90 to 100% by mass.

In the lubricating oil composition according to one embodiment of the present invention, the content of the base oil (A) is preferably 55% by mass or more, more preferably 60% by mass or more, still more preferably 65% by mass or more, yet still more preferably 70% by mass or more, and especially preferably 75% by mass or more, and it is preferably 99.5% by mass or less, more preferably 99.0% by mass or less, and still more preferably 95.0% by mass or less, on the basis of the whole amount (100% by mass) of the lubricating oil composition.

<Olefin-Based Polymer (A1)>

The olefin-based polymer (A1) which is used in the lubricating oil composition of the present invention satisfies the following requirements (a1) to (a5).

Requirement (a1): An area ratio of a peak derived from a hydride (A11) of a decene trimer is 80% or more relative to 100% of a total area of peaks derived from the olefin-based polymer (A1) detected in a chromatogram on performing chromatography analysis.

Requirement (a2): A kinematic viscosity at 40° C. is 16.0 $mm^2/s$ or less.

Requirement (a3): A kinematic viscosity at 100° C. is 3.0 to 4.0 $mm^2/s$.

Requirement (a4): A flash point is 220° C. or higher.

Requirement (a5): A pour point is −30° C. or lower.

The olefin-based polymer (A1) is a polymer having a structural unit derived from an α-olefin.

The olefin-based polymer (A1) may be used alone or may be used in combination of two or more thereof.

Here, in the case where the olefin-based polymer (A1) is a mixture of two or more olefin-based polymers, the mixture may be one satisfying the aforementioned requirements (a1) to (a5).

In the requirement (a1), it is prescribed that an area ratio of a peak derived from a hydride (A11) of a decene trimer is 80% or more relative to 100% of a total area of peaks derived from the olefin-based polymer (A1) detected in a chromatogram on performing chromatography analysis.

Namely, in the requirement (a1), a content ratio (purity) of the hydride (A11) of a decene trimer in the olefin-based polymer (A1) is prescribed.

In calculating the area ratio prescribed in the requirement (a1), the chromatography analysis may be performed on the olefin-based polymer (A1), and the chromatography analysis may also be performed on the lubricating oil composition containing the olefin-based polymer (A1). In the latter case, after a peak derived from the olefin-based polymer (A1) is specified from the chromatogram acquired, the aforementioned area ratio can be calculated.

The hydride (A11) of a decene trimer refers to a hydride of a polymer resulting through polymerization of three molecules of 1-decene.

The olefin-based polymer (A1) may contain a hydride of a decene oligomer other than the decene trimer and may also contain a structural unit derived from an α-olefin other than 1-decene.

The olefin-based polymer (A1) may contain a non-hydrogenated decene trimer.

However, in the present invention, in the olefin-based polymer (A1), it is needed that the content ratio (purity) of the hydride (A11) of a decene trimer satisfies the aforementioned requirement (a1).

The presence of the hydride (A11) of a decene trimer contributes to a reduction of the HTHS viscosity ($H_{50}$) at 50° C. Accordingly, by using the olefin-based polymer (A1) satisfying the requirement (a1), it becomes easy to prepare the lubricating oil composition satisfying the requirement (II).

As a result, it becomes possible to provide the lubricating oil composition having excellent fuel consumption reducing properties in a low-temperature area.

Although the area ratio of a peak derived from the hydride (A11) of a decene trimer as prescribed in the requirement (a1) is 80% or more, it is preferably 83% or more, and more preferably 85% or more.

In this specification, the area ratio of a peak derived from the hydride (A11) of a decene trimer as prescribed in the requirement (a1) means a value measured and calculated on the basis of the method described in the section of Examples.

From the viewpoint of providing the lubricating oil composition satisfying the requirement (II), as prescribed in the aforementioned requirement (a2), the kinematic viscosity at 40° C. of the olefin-based polymer (A1) is 16.0 $mm^2/s$ or less, preferably 15.5 $mm^2/s$ or less, more preferably 15.0 $mm^2/s$ or less, still more preferably 14.5 $mm^2/s$ or less, and yet still more preferably 14.0 $mm^2/s$ or less.

From the viewpoint of preparing the lubricating oil composition satisfying the requirement (III), the kinematic viscosity at 40° C. of the olefin-based polymer (A1) is preferably 2.0 $mm^2/s$ or more, more preferably 5.0 $mm^2/s$ or more, and still more preferably 7.0 $mm^2/s$ or more.

From the viewpoint of preparing the lubricating oil composition satisfying the requirements (I) and (III), as prescribed in the aforementioned requirement (a3), the kinematic viscosity at 100° C. of the olefin-based polymer (A1) is 3.0 to 4.0 $mm^2/s$, preferably 3.1 to 3.9 $mm^2/s$, more preferably 3.2 to 3.8 $mm^2/s$, and still more preferably 3.3 to 3.7 $mm^2/s$.

In one embodiment of the present invention, the viscosity index of the olefin-based polymer (A1) is preferably 100 or more, more preferably 105 or more, still more preferably 110 or more, and yet still more preferably 120 or more.

From the viewpoint of preparing the lubricating oil composition satisfying the requirement (III) and having low evaporativity and excellent thermal stability, as prescribed in the aforementioned requirement (a4), the flash point of the olefin-based polymer (A1) is 220° C. or higher, preferably 222° C. or higher, more preferably 224° C. or higher, still more preferably 226° C. or higher, and yet still more preferably 230° C. or higher.

The flash point of the olefin-based polymer (A1) is typically 250° C. or lower.

In this specification, the flash point means a value measured in conformity with JIS K2265-4 (Cleveland open cup method (COC method)).

From the viewpoint of providing the lubricating oil composition having excellent viscosity characteristics over a wide temperature range, as prescribed in the aforementioned requirement (a5), the pour point of the olefin-based polymer (A1) is −30° C. or lower, preferably −35° C. or lower, more preferably −40° C. or lower, still more preferably −45° C. or lower, and yet still more preferably lower than −50° C.

In this specification, the pour point means a value measured in conformity with JIS K2269.

Although the raw material monomer constituting the olefin-based polymer (A1) includes at least 1-decene, an α-olefin other than 1-decene may be contained within a range where the requirement (a1) is satisfied.

As the α-olefin other than 1-decene, an α-olefin having 6 to 20 carbon atoms is preferred, and specifically, examples thereof include 1-hexene, 1-heptene, 1-octene, 1-nonene, 1-undecene, 1-dodecene, 1-tridecene, 1-tetradecene, 1-pentadecene, 1-hexadecene, 1-heptadecene, 1-octadecene, 1-nonadecene, and 1-eicosene.

These α-olefins may be used alone or may be used in combination of two or more thereof.

From the viewpoint of obtaining the olefin-based polymer (A1) satisfying the requirement (a1), the content ratio of 1-decene in the raw material monomer constituting the olefin-based polymer (A1) is preferably 80 to 100% by mass, more preferably 90 to 100% by mass, still more preferably 95 to 100% by mass, and yet still more preferably 100% by mass on the basis of the whole amount (100% by mass) of the raw material monomer.

Now, as a general synthesis method of an olefin-based polymer, in many cases, a method of obtaining the olefin-based polymer through a polymerization reaction of an α-olefin by using an acid catalyst, such as a $BF_3$ catalyst, is adopted.

However, in the olefin-based polymer obtained by the aforementioned synthesis method, even when only 1-decene is used as the raw material monomer, the content ratio (purity) of the decene trimer in the product obtained is low. In order to provide the olefin-based polymer (A) satisfying the requirement (a1), in many cases, it is needed to perform a purification treatment for the purpose of removing a by-product other than the decene trimer from the product.

Meanwhile, when the polymerization of an α-olefin is performed using a metallocene catalyst, the content ratio (purity) of the decene trimer in the olefin-based polymer obtained is high, and it is easy to prepare the olefin-based polymer (A) satisfying the requirement (a1).

At the time of polymerization reaction, a co-catalyst may be used together with the metallocene complex. It is preferred to use an oxygen-containing organoaluminum compound as the co-catalyst.

The metallocene catalyst that is used in one embodiment of the present invention may be a complex containing an element belonging to the Group 4 and having a conjugated carbon 5-membered ring.

Examples of the element belonging to the Group 4 include titanium, zirconium, and hafnium, with zirconium being preferred.

As the complex having a conjugated carbon 5-membered ring, a complex having a substituted or unsubstituted cyclopentadienyl ligand is preferred.

Examples of the metallocene catalyst that is used in one embodiment of the present invention include bis(n-octadecylcyclopentadienyl)zirconium dichloride, bis(trimethylsilylcyclopentadienyl)zirconium dichloride, bis(tetrahydroindenyl)zirconium dichloride, bis[(t-butyldimethylsilyl)cyclopentadienyl]zirconium dichloride, bis(di-t-butylcyclopentadienyl)zirconium dichloride, (ethylidenebisindenyl)zirconium dichloride, biscyclopentadienyl zirconium dichloride, ethylidenebis(tetrahydroindenyl)zirconium dichloride, and bis[3,3-(2-methyl-benzindenyl)]dimethylsilanediylzirconiumdichloride.

These metallocene catalysts may be used alone or may be used in combination of two or more thereof.

Examples of the oxygen-containing organoaluminum compound which is used as the co-catalyst include methylalumoxane, ethylalumoxane, and isobutylalumoxane.

These compounds may be used alone or may be used in combination of two or more thereof.

From the viewpoint of obtaining the olefin-based polymer (A1) satisfying the requirement (a1), a blending ratio of the co-catalyst to the metallocene catalyst [(co-catalyst)/(metallocene complex)] is preferably 5 to 1,000, more preferably 7 to 500, and still more preferably 10 to 200.

The olefin-based polymer (A1) that is used in one embodiment of the present invention is preferably one obtained through the following steps (i) to (iii).

Step (i): A step of polymerizing the aforementioned α-olefin-containing raw material monomer by using the aforementioned metallocene catalyst, to obtain a polymer.

Step (ii): A step of treating the aforementioned polymer with an alkali.

Step (iii): A step of subjecting the polymer after the step (ii) to a hydrogenation treatment.

(Step (i))

The polymerization of the step (i) may be a batch system or may be a continuous system. In addition, the aforementioned oxygen-containing organoaluminum compound that is the co-catalyst may be used together with the metallocene catalyst.

In the step (i), the polymerization of the raw material monomer may be advanced in the presence of an organic solvent, such as benzene, ethylbenzene, and toluene.

The polymerization reaction in the step (i) is preferably performed under conditions at a reaction temperature of 15 to 100° C. under a reaction pressure of atmospheric pressure to 0.2 MPa.

After the polymerization is thoroughly advanced, the reaction can be terminated upon addition of water or an alcohol.

(Step (ii))

The step (ii) is a step of treating the polymer obtained in the step (i) with an alkali, thereby removing the catalyst component, such as the metallocene catalyst and the oxygen-containing organoaluminum compound.

Examples of the alkali which is used in the step (ii) include sodium hydroxide, sodium carbonate, and sodium hydrogencarbonate.

After a solution of such an alkali dissolved in water or an alcohol, such as methanol, ethanol, and propanol, is added to the reaction liquid containing the polymer, the contents are then thoroughly stirred and subjected to a liquid separation operation, and an organic layer is taken out, whereby the catalyst component can be removed.

The pH of the foregoing solution is preferably 9 or more. In addition, the temperature of the solution is preferably 20 to 100° C.

(Step (iii))

The polymer produced with the metallocene catalyst has a double bond, and in particular, the content of a terminal vinylidene double bond is high. The double bond which the foregoing polymer has becomes a cause to hinder the use as an engine oil. Accordingly, in the step (iii), the hydrogenation treatment of the polymer is performed to convert the polymer into a hydride. The hydride is preferably a complete hydride.

The hydrogenation treatment in the step (iii) is performed by filling a hydrogen gas in a system containing the polymer and heating in the presence of a metal catalyst.

As the metal catalyst which is used for the hydrogenation treatment, for example, a nickel-based catalyst, a cobalt-based catalyst, a palladium-based catalyst, a platinum-based catalyst, and so on can be used. Specifically, examples thereof include a diatomaceous earth-supported nickel catalyst, a cobalt trisacetyl acetonate/organoaluminum catalyst, an active carbon-supported palladium catalyst, and an alumina-supported platinum catalyst.

As for the temperature conditions of the hydrogenation treatment, the temperature is typically 200° C. or lower and is appropriately set depending upon the kind of the metal catalyst used.

For example, in the case of using a nickel-based catalyst, the temperature is preferably 150 to 200° C.

In the case of using a palladium-based catalyst or a platinum-based catalyst, the temperature is preferably 50 to 150° C.

In the case of using a homogeneous reducing agent, such as a cobalt trisacetyl acetonate/organoaluminum catalyst, the temperature is preferably 20 to 100° C.

As for the hydrogen pressure on performing the hydrogenation treatment, the pressure is preferably atmospheric pressure to 20 MPa.

After the hydrogenation treatment, it is preferred to perform a distillation treatment to remove a by-product.

The distillation treatment is preferably performed under conditions at a temperature of 180 to 450° C. under a pressure of 0.01 to 100 kPa.

<Ether Compound (A2)>

In the lubricating oil composition according to one embodiment of the present invention, it is preferred that the base oil (A) further contains an ether compound (A2) represented by the following general formula (1) together with the olefin-based polymer (A1).

$$R^1—O—R^2 \quad (1)$$

In the general formula (1), $R^1$ and $R^2$ each independently represent an alkyl group having 6 to 22 carbon atoms.

Examples of the alkyl group include a hexyl group, a heptyl group, an octyl group, a 2-ethylhexyl group, a nonyl group, a decyl group, an undecyl group, a dodecyl group, a tridecyl group, a tetradecyl group, a hexadecyl group, an octadecyl group, an eicosyl group, and an isoeicosyl group.

Such an alkyl group may be a linear alkyl group or may be a branched alkyl group.

Although $R^1$ and $R^2$ may be the same as or different from each other, they are preferably an alkyl group different from each other.

As for the ether compound (A2) that is used in one embodiment of the present invention, it is more preferred that one of $R^1$ and $R^2$ in the general formula (1) is an alkyl group having 6 to 14 carbon atoms (more preferably 6 to 12 carbon atoms, and still more preferably 6 to 10 carbon atoms), and the other is an alkyl group having 15 to 22 carbon atoms (more preferably 16 to 22 carbon atoms, and still more preferably 18 to 22 carbon atoms).

From the viewpoint of providing the ether compound (A2) having an appropriately high pour point, the total carbon number of $R^1$ and $R^2$ in the general formula (1) is preferably 24 or more, more preferably 26 or more, and still more preferably 28 or more, and from the viewpoint of providing the ether compound (A2) having good viscosity characteristics, it is preferably 36 or less, more preferably 34 or less, and still more preferably 30 or less.

From the viewpoint of providing the ether compound (A2) having an appropriately high pour point and good viscosity characteristics, it is preferred that one of $R^1$ and $R^2$ in the general formula (1) is a linear alkyl group, and the other is a branched alkyl group.

The ether compound (A2) of the aforementioned embodiment is more preferably an ether compound (A2-1) represented by the following general formula (2).

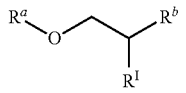

(2)

In the general formula (2), $R^a$ is a linear alkyl group having 6 to 22 carbon atoms.

$R^b$ and $R^c$ are each a linear alkyl group, and the total carbon number of $R^b$ and $R^c$ is 4 to 20.

From the viewpoint of improving the viscosity index, the carbon number of the linear alkyl group which may be selected as $R^a$ is more preferably 7 or more, and still more preferably 8 or more, and from the viewpoint of regulating the kinematic viscosity at 100° C. to an appropriate range, it is more preferably 14 or less, and still more preferably 10 or less.

From the viewpoint of improving the viscosity index, the total carbon number of $R^b$ and $R^c$ is more preferably 13 or more, still more preferably 14 or more, and yet still more preferably 16 or more, and from the viewpoint of regulating the kinematic viscosity at 100° C. to an appropriate range, it is more preferably 21 or less, and still more preferably 20 or less.

The kinematic viscosity at 100° C. of the ether compound (A2) that is used in one embodiment of the present invention is preferably 2.5 to 3.3 $mm^2/s$, more preferably 2.8 to 3.2 $mm^2/s$, and still more preferably 2.8 to 3.1 $mm^2/s$.

The viscosity index of the ether compound (A2) that is used in one embodiment of the present invention is preferably 130 or more, more preferably 135 or more, and still more preferably 140 or more.

In the lubricating oil composition according to one embodiment of the present invention, the content of the ether compound (A2) is preferably 30 to 300 parts by mass, more preferably 80 to 280 parts by mass, still more preferably 90 to 260 parts by mass, and yet still more preferably 100 to 250 parts by mass based on 100 parts by mass of the olefin-based polymer (A1).

When the content of the ether compound (A2) is 30 parts by mass or more, it becomes easy to prepare the lubricating oil composition satisfying the requirement (II). Meanwhile, when the content of the ether compound (A2) is 300 parts by mass or less, it is able to readily reveal the friction reducing effect of the organic molybdenum-based compound.

<Other Base Oil than Components (A1) and (A2)>

In the lubricating oil composition according to one embodiment of the present invention, as the base oil (A), other base oil than the components (A1) and (A2) may be contained within a range where the effects of the present invention are not impaired.

The other base oil may be a mineral oil, may be a synthetic oil, or may be a mixed oil of a mineral oil and a synthetic oil so long as it is a base oil other than the olefin-based polymer and the ether compound.

The mineral oil may be used either alone or in combination of two or more thereof.

The synthetic oil may be used either alone or in combination of two or more thereof.

The mixed oil may be a combination of at least one selected from the mineral oil and at least one selected from the synthetic oil.

Examples of the mineral base oil include a topped crude obtained by atmospheric distillation of a paraffinic crude oil, an intermediate crude oil, a naphthenic crude oil, or the like; a distillate oil obtained by vacuum distillation of the topped crude; and a mineral oil or a wax (e.g., a slack wax and a GTL wax) obtained by subjecting the distillate oil to at least one purification process, such as solvent deasphalting, solvent extraction, hydrofinishing, solvent dewaxing, catalytic dewaxing, isomerization dewaxing, and vacuum distillation.

Examples of the synthetic oil include an ether-based compound which is not corresponding to the component (A2), a polyglycol, an alkylbenzene, and an alkylnaphthalene.

In one embodiment of the present invention, from the viewpoint of providing the lubricating oil composition satisfying the requirements (I) to (III) and suitable for a hybrid car and the viewpoint of suppressing swelling or solidification at a low temperature of the rubber material, it is preferred that the content of a monoester compound and a diester compound is as small as possible.

In the lubricating oil composition according to one embodiment of the present invention, the total content of the monoester compound and the diester compound is preferably 0 to 10% by mass, more preferably 0 to 5% by mass, still more preferably 0 to 1% by mass, and yet still more preferably 0 to 0.1% by mass on the basis of the whole amount (100% by mass) of the base oil (A) in the lubricating oil composition.

<Viscosity Index Improver (B)>

The lubricating oil composition of the present invention contains the viscosity index improver (B) containing the comb-shaped polymer (B1).

Since the lubricating oil composition of the present invention contains the comb-shaped polymer (B1) as the viscosity index improver (B) together with the olefin-based polymer (A1), when used as an engine oil of the hybrid car, even in a low-temperature area at around 50° C., the viscosity can be decreased to an extent prescribed in the requirement (II).

As compared with the case of blending a polymethacrylate or an olefin-based copolymer, each of which is a general viscosity index improver, by blending the comb-shaped polymer (B1), the solubility of the organic molybdenum-based compound (C) in the base oil (A) is more improved, whereby the friction reducing effect may be more revealed.

Furthermore, in the case of using a polymethacrylate that is a general viscosity index improver, or the like, the HTHS viscosity of the lubricating oil composition obtained is liable to increase, and there is a concern about a lowering of the fuel consumption reducing properties.

On the other hand, in the lubricating oil composition of the present invention, by using the comb-shaped polymer (B1) as the viscosity index improver, the increase of the HTHS viscosity is suppressed, whereby the excellent fuel consumption reducing properties can be revealed.

The viscosity index improver (B) that is used in one embodiment of the present invention may contain a viscosity index improver composed of other resin component which is not corresponding to the comb-shaped polymer (B1), or the unreacted raw materials and catalyst used at the time of synthesis of the comb-shaped polymer (B1) as well as a by-product, such as a resin component as formed at the time of synthesis, which is not corresponding to the comb-shaped polymer, within a range where the effects of the present invention are not impaired.

In this specification, the aforementioned "resin component" means a polymer having a mass average molecular weight (Mw) of 1,000 or more and having a fixed repeating unit.

Examples of the viscosity index improver composed of other resin component which is not corresponding to the comb-shaped polymer (B1) include a polymethacrylate, a dispersion type polymethacrylate, an olefin-based copolymer (for example, an ethylene-propylene copolymer), a dispersion type olefin-based copolymer, and a styrenic copolymer (for example, a styrene-diene copolymer and a styrene-isoprene copolymer).

The content of the aforementioned by-product is preferably 10% by mass or less, more preferably 5% by mass or less, still more preferably 1% by mass or less, and yet still more preferably 0.1% by mass or less on the basis of the whole amount (100% by mass) of the solid component in the viscosity index improver (B).

The aforementioned "solid component in the viscosity index improver (B)" means a component in which a diluent oil is eliminated from the viscosity index improver (B) and includes not only the comb-shaped polymer (B1) but also other resin component or by-product which is not corresponding to the comb-shaped polymer (B1).

The viscosity index improver (B) that is used in one embodiment of the present invention is one containing the comb-shaped polymer (B1). However, in general, taking into consideration handling properties or solubility in the base oil (A), in many cases, the viscosity index improver is put on the market in a form of a solution in which the solid component containing a resin component, such as the comb-shaped polymer (B1), is dissolved with a diluent oil, such as a mineral oil and a synthetic oil.

In the case where the viscosity index improver (B) is in a form of the solution, the solid component concentration of the solution is typically 5 to 30% by mass on the basis of the whole amount (100% by mass) of the solution.

In the lubricating oil composition according to one embodiment of the present invention, the content of the viscosity index improver (B) is preferably 0.30 to 3.20% by mass, more preferably 0.35 to 3.00% by mass, still more preferably 0.40 to 2.70% by mass, yet still more preferably 0.45 to 2.40% by mass, and even yet still more preferably 0.50 to 1.90% by mass on the basis of the whole amount (100% by mass) of the lubricating oil composition.

In this specification, the aforementioned "content of the viscosity index improver (B)" and the "content of the comb-shaped polymer (B1)" as mentioned later are each a solid component amount including the comb-shaped polymer (B1) and the aforementioned other resin component but not including the mass of the diluent oil.

The content of the comb-shaped polymer (B1) in the whole amount (solid component amount, 100% by mass) of the viscosity index improver (B) which is contained in the lubricating oil composition according to one embodiment of the present invention is preferably 70 to 100% by mass, more preferably 80 to 100% by mass, still more preferably 85 to 100% by mass, and yet still more preferably 90 to 100% by mass.

<Comb-Shaped Polymer (B1)>

In the present invention, the "comb-shaped polymer" refers to a polymer having a structure having a large number of trigeminal branch points from which a high-molecular weight side chain comes out in a main chain thereof.

When used as an engine oil of the hybrid car, the presence of the comb-shaped polymer (B1) contributes to the fuel consumption reducing properties in a low-temperature area at around 50° C., and therefore, it becomes easy to prepare the lubricating oil composition satisfying the required (II).

From the viewpoint of improving the fuel consumption reducing performance, a mass average molecular weight (Mw) of the comb-shaped polymer (B1) is preferably 100,000 to 1,000,000, more preferably 200,000 to 800,000, still more preferably 250,000 to 750,000, yet still more preferably 300,000 to 700,000, and especially preferably 350,000 to 650,000.

From the viewpoint of improving the fuel consumption reducing performance of the lubricating oil composition, a molecular weight distribution (Mw/Mn) of the comb-shaped polymer (B1) (Mw represents a mass average molecular weight of the comb-shaped polymer (B1), and Mn represents a number average molecular weight of the comb-shaped polymer (B1)) is preferably 8.00 or less, more preferably 7.00 or less, still more preferably 6.50 or less, yet still more preferably 6.00 or less, even yet still more preferably 5.00 or less, and even still more preferably 3.00 or less. As the molecular weight distribution of the comb-shaped polymer (B1) is smaller, the fuel consumption reducing performance of the lubricating oil composition containing the comb-shaped polymer (B1) together with the base oil (A) tends to be more improved.

Although the molecular weight distribution of the comb-shaped polymer (B1) is not particularly limited with respect to its lower limit value, it is typically 1.01 or more, preferably 1.05 or more, and more preferably 1.10 or more.

In the lubricating oil composition of the present invention, the content of the comb-shaped polymer (B1) is 0.30% by mass or more, preferably 0.35% by mass or more, more preferably 0.40% by mass or more, still more preferably 0.45% by mass or more, yet still more preferably 0.50% by mass or more, and especially preferably 0.75% by mass or more on the basis of the whole amount (100% by mass) of the lubricating oil composition.

When the content of the comb-shaped polymer (B1) is less than 0.30% by mass, it becomes difficult to prepare the lubricating oil composition satisfying all of the requirements (I) to (III). In particular, it is difficult to improve the fuel consumption reducing properties when used in both a high-temperature environment and a low-temperature environment. In addition, a harm that the friction reducing effect by the addition of the organic molybdenum-based compound (C) is not thoroughly revealed is possibly caused.

In the lubricating oil composition according to one embodiment of the present invention, the content of the comb-shaped polymer (B1) is preferably 3.20% by mass or less, more preferably 3.00% by mass or less, still more preferably 2.70% by mass or less, yet still more preferably 2.40% by mass or less, and even yet still more preferably 1.90% by mass or less on the basis of the whole amount (100% by mass) of the lubricating oil composition.

SSI (shear stability index) of the comb-shaped polymer (B1) is preferably 12.0 or less, more preferably 10.0 or less, still more preferably 5.0 or less, yet still more preferably 3.0 or less, and especially preferably less than 1.0.

Although the SSI of the comb-shaped polymer (B1) is not particularly limited with respective to its lower limit value, it is typically 0.1 or more, and preferably 0.2 or more.

In this specification, the SSI (shear stability index) of the comb-shaped polymer (B1) expresses a percentage of a lowering of the viscosity by shearing originated from the resin component in the comb-shaped polymer (B1) and is a value measured in conformity with ASTM D6278. More specifically, the SSI is a value as calculated according to the following calculation formula (1).

$$SSI = \frac{Kv_0 - Kv_1}{Kv_0 - Kv_{oil}} \times 100 \quad (1)$$

In the formula (1), $Kv_0$ represents a value of kinematic viscosity at 100° C. of a sample oil obtained by diluting the resin component-containing viscosity index improver in a mineral oil; and $Kv_1$ represents a value of kinematic viscosity at 100° C. after passing a sample oil obtained by diluting the resin component-containing viscosity index improver in a mineral oil through a high-shear diesel injector for 30 cycles according to the procedures of ASTM D6278. In addition, $Kv_{oil}$ denotes a value of kinematic viscosity at 100° C. of the mineral oil used on the occasion of diluting the viscosity index improver.

The value of SSI of the comb-shaped polymer (B1) varies with the structure of the comb-shaped polymer (B1). Specifically, there are the following tendencies, and by considering these matters, the value of SSI of the comb-shaped polymer (B1) can be easily regulated. The following matters merely represent an example to the bitter end, and it is also possible to make regulations by considering matters different from the following matters.

- The side chain of the comb-shaped polymer is constituted of a macromonomer (x1), and as for the comb-shaped polymer in which the content of a structural unit (X1) derived from the macromonomer (x1) is 0.5 mol % or more on the basis of the whole amount (100 mol %) of the structural units, the value of SSI of the comb-shaped polymer tends to become low.
- As the molecular weight of the macromonomer (x1) constituting the side chain of the comb-shaped polymer is higher, the value of SSI tends to become low.

<Structural Unit of Comb-Shaped Polymer (B1)>

The structural unit of the comb-shaped polymer (B1) that is used in one embodiment of the present invention is hereunder described.

In one embodiment of the present invention, "the use of comb-shaped polymer (B1) does not necessarily result in a lubricating oil composition satisfying the requirement (II)".

In general, the comb-shaped polymer is known to have a very large number of structures.

In the present invention, a specified comb-shaped polymer (B1) is selected from the comb-shaped polymers present in such a large number considering the preferred embodiments described above appropriately to prepare a lubricating oil composition satisfying the requirement (II).

In the following description, the matters relating to preferred embodiments of the respective structural units are indicated as means for regulating the lubricating oil composition satisfying the requirement (II) unless otherwise specified.

As the comb-shaped polymer (B1), a polymer having at least the structural unit (X1) derived from the macromonomer (x1) is preferred. This structural unit (X1) is corresponding to the aforementioned "high-molecular weight side chain".

In the present invention, the aforementioned "macromonomer" means a high-molecular weight monomer having a polymerizable functional group and is preferably a high-molecular weight monomer having a polymerizable functional group in an end thereof.

A comb-shaped polymer having a relatively long main chain with respect to a side chain has low shear stability. It may be considered that such properties contribute to an improvement of the fuel consumption properties even in a low-temperature area at around 50° C.

In the comb-shaped polymer (B1) that is used in one embodiment of the present invention, from the aforementioned viewpoint, the content of the structural unit (X1) is preferably 0.1 mol % or more and less than 10 mol %, more preferably 0.2 to 7 mol %, still more preferably 0.3 to 5 mol %, and yet still more preferably 0.5 to 3 mol % on the basis of the whole amount (100 mol %) of the structural unit of the comb-shaped polymer (B1).

In this specification, the content of each structural unit in the comb-shaped polymer (B1) means a value calculated by analyzing the $^{13}$C-NMR quantitative spectrum.

From the aforementioned viewpoint, a number average molecular weight (Mn) of the macromonomer (x1) is preferably 300 or more, more preferably 500 or more, still more preferably 1,000 or more, yet still more preferably 2,000 or more, and especially preferably 4,000 or more, and it is preferably 100,000 or less, more preferably 50,000 or less, still more preferably 20,000 or less, and yet still more preferably 10,000 or less.

Examples of the polymerizable functional group which the macromonomer (x1) has include an acryloyl group ($CH_2$═CH—COO—), a methacryloyl group ($CH_2$═$CCH_3$—COO—), an ethenyl group ($CH_2$═CH—), a vinyl ether group ($CH_2$═CH—O—), an allyl group ($CH_2$═CH—$CH_2$—), an allyl ether group ($CH_2$═CH—$CH_2$—O—), a group represented by $CH_2$═CH—CONH—, and a group represented by $CH_2$═$CCH_3$—CONH—.

The macromonomer (x1) may also have at least one selected from repeating units represented by the following general formulae (i) to (iii) in addition to the aforementioned polymerizable functional groups.

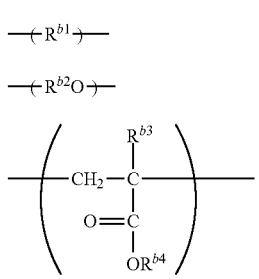

In the general formula (i), $R^{b1}$ represents a linear or branched alkylene group having 1 to 10 carbon atoms, and specifically, examples thereof include a methylene group, an ethylene group, a 1,2-propylene group, a 1,3-propylene group, a 1,2-butylene group, a 1,3-butylene group, a 1,4-butylene group, a pentylene group, a hexylene group, a heptylene group, an octylene group, a nonylene group, a decylene group, and a 2-ethylhexylene group.

In the general formula (ii), $R^{b2}$ represents a linear or branched alkylene group having 2 to 4 carbon atoms, and specifically, examples thereof include an ethylene group, a 1,2-propylene group, a 1,3-propylene group, a 1,2-butylene group, a 1,3-butylene group, and a 1,4-butylene group.

In the general formula (iii), $R^{b3}$ represents a hydrogen atom or a methyl group.

$R^{b4}$ represents a linear or branched alkyl group having 1 to 10 carbon atoms, and specifically, examples thereof include a methyl group, an ethyl group, a n-propyl group, a n-butyl group, a n-pentyl group, a n-hexyl group, a n-heptyl group, a n-octyl group, a n-nonyl group, a n-decyl group, an isopropyl group, an isobutyl group, a sec-butyl group, a t-butyl group, an isopentyl group, a t-pentyl group, an isohexyl group, a t-hexyl group, an isoheptyl group, a t-heptyl group, a 2-ethylhexyl group, an isooctyl group, an isononyl group, and an isodecyl group.

In the case where the macromonomer (x1) has a plurality of repeating units represented by each of the general formulae (i) to (iii), $R^{b1}$'s, $R^{b2}$'s, $R^{b3}$'s, and $R^{b4}$'s may be each the same as or different from each other.

In one embodiment of the present invention, the macromonomer (x1) is preferably a polymer having a repeating unit represented by the general formula (i), and more preferably a polymer having a repeating unit (X1-1) in which $R^{b1}$ in the general formula (i) is a 1,2-butylene group and/or a 1,4-butylene group.

The content of the repeating unit (X1-1) is preferably 1 to 100 mol %, more preferably 20 to 95 mol %, still more preferably 40 to 90 mol %, and yet still more preferably 50 to 80 mol % on the basis of the whole amount (100 mol %) of the structural unit of the macromonomer (x1).

In the case where the macromonomer (x1) is a copolymer having two or more repeating units selected from the general formulae (i) to (iii), the mode of the copolymer may be a block copolymer or may be a random copolymer.

The comb-shaped polymer (B1) that is used in one embodiment of the present invention may be a homopolymer composed of only the structural unit (X1) derived from one kind of the macromonomer (x1) or may be a copolymer containing the structural unit (X1) derived from two or more kinds of the macromonomer (x1).

The comb-shaped polymer (B1) that is used in one embodiment of the present invention may also be a copolymer containing the structural unit derived from the macromonomer (x1) as well as a structural unit (X2) derived from other monomer (x2) than the macromonomer (x1).

As a specific structure of such a comb-shaped polymer, a copolymer having a side chain containing the structural unit (X1) derived from the macromonomer (x1) relative to the main chain containing the structural unit (X2) derived from the monomer (x2) is preferred. A copolymer having also containing the structural unit (X1) derived from the macromonomer (x1) as a main chain relative to the main chain containing the structural unit (X2) derived from the monomer (x2) is more preferred.

Examples of the monomer (x2) include a monomer (x2-a) represented by the following general formula (a1), an alkyl (meth)acrylate (x2-b), a nitrogen atom-containing vinyl monomer (x2-c), a hydroxy group-containing vinyl monomer (x2-d), a phosphorus atom-containing monomer (x2-e), an aliphatic hydrocarbon-based vinyl monomer (x2-f), an alicyclic hydrocarbon-based vinyl monomer (x2-g), a vinyl ester (x2-h), a vinyl ether (x2-i), a vinyl ketone (x2-j), an epoxy group-containing vinyl monomer (x2-k), a halogen element-containing vinyl monomer (x2-1), an ester of unsaturated polycarboxylic acid (x2-m), a (di)alkyl fumarate (x2-n), a (di)alkyl maleate (x2-o), and an aromatic hydrocarbon-based vinyl monomer (x2-p).

As the monomer (x2), the monomers other than the nitrogen atom-containing vinyl monomer (x2-c), the phosphorus atom-containing monomer (x2-e), and the aromatic hydrocarbon-based vinyl monomer (x2-p) are preferred.

As the monomer (x2), it is preferable to contain at least one selected from a monomer (x2-a) represented by the following general formula (a1), an alkyl (meth)acrylate (x2-b), and a hydroxy group-containing vinyl monomer (x2-d), and it is more preferable to contain at least a hydroxy group-containing vinyl monomer (x2-d).

(Monomer (x2-a) Represented by Following General Formula (a1))

(a1)

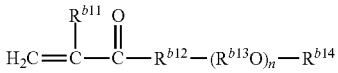

In the general formula (a1), $R^{b11}$ represents a hydrogen atom or a methyl group.

$R^{b12}$ represents a single bond, a linear or branched alkylene group having 1 to 10 carbon atoms, —O—, or —NH—.

$R^{b13}$ represents a linear or branched alkylene group having 2 to 4 carbon atoms. In addition, n represents an integer of 1 or more (preferably an integer of 1 to 20, and more preferably an integer of 1 to 5). In the case where n is an integer of 2 or more, plural $R^{b13}$'s may be the same as or different from each other, and furthermore, the $(R^{b13}O)_n$ moiety may be either a random bond or a block bond.

$R^{b14}$ represents a linear or branched alkyl group having 1 to 60 carbon atoms (preferably 10 to 50 carbon atoms, and more preferably 20 to 40 carbon atoms).

Specific groups of the aforementioned "linear or branched alkylene group having 1 to 10 carbon atoms", "linear or branched alkylene group having 2 to 4 carbon atoms", and "linear or branched alkyl group having 1 to 60 carbon atoms" include the same groups as those exemplified in the descriptions regarding the aforementioned general formulae (i) to (iii).

(Alkyl (Meth)acrylate (x2-b))

Examples of the alkyl (meth)acrylate (x2-b) include methyl (meth)acrylate, ethyl (meth)acrylate, n-propyl (meth)acrylate, isopropyl (meth)acrylate, n-butyl (meth) acrylate, t-butyl (meth)acrylate, pentyl (meth)acrylate, hexyl (meth)acrylate, 2-ethylhexyl (meth)acrylate, heptyl (meth) acrylate, 2-t-butylheptyl (meth)acrylate, octyl (meth)acrylate, and 3-isopropylheptyl (meth)acrylate.

The carbon number of the alkyl group which the alkyl (meth)acrylate (x2-b) has is preferably 4 to 30, more preferably 4 to 24, and still more preferably 4 to 18.

The foregoing alkyl group may be a linear alkyl group or may be a branched alkyl group.

In one embodiment of the present invention, in the case where the monomer (x2) contains, as the alkyl (meth) acrylate (x2-b), both butyl (meth)acrylate and an alkyl (meth)acrylate having an alkyl group having 12 to 20 carbon atoms, it is easy to prepare the lubricating oil composition satisfying the requirement (II).

The content ratio [(α)/(β)] of the structural unit (α) derived from the butyl (meth)acrylate to the structural unit (β) derived from the alkyl (meth)acrylate having an alkyl group having 12 to 20 carbon atoms is preferably 7.00 or more, more preferably 8.50 or more, and still more preferably 10.00 or more, and it is preferably 20 or less, in terms of molar ratio.

The content of the structural unit (α) derived from the butyl (meth)acrylate is preferably 40 to 95 mol %, more preferably 50 to 90 mol %, and still more preferably 60 to 85 mol % on the basis of the whole amount (100 mol %) of the structural unit of the comb-shaped polymer (B1).

The content of the structural unit (β) derived from the alkyl (meth)acrylate having an alkyl group having 12 to 20 carbon atoms is preferably 1 to 30 mol %, more preferably 3 to 25 mol %, and still more preferably 5 to 20 mol % on the basis of the whole amount (100 mol %) of the structural unit of the comb-shaped polymer (B1).

(Nitrogen Atom-Containing Vinyl Monomer (x2-c))

Examples of the nitrogen atom-containing vinyl monomer (x2-c) include an amide group-containing vinyl monomer (x2-c1), a nitro group-containing monomer (x2-c2), a primary amino group-containing vinyl monomer (x2-c3), a secondary amino group-containing vinyl monomer (x2-c4), a tertiary amino group-containing vinyl monomer (x2-c5), and a nitrile group-containing vinyl monomer (x2-c6).

Examples of the amide group-containing vinyl monomer (x2-c1) include (meth)acrylamide; monoalkylamino (meth) acrylamides, such as N-methyl (meth)acrylamide, N-ethyl (meth)acrylamide, N-isopropyl (meth)acrylamide, N-n-butyl (meth)acrylamide, and N-isobutyl (meth)acrylamide; monoalkylaminoalkyl (meth)acrylamides, such as N-methylaminoethyl (meth)acrylamide, N-ethylaminoethyl (meth) acrylamide, N-isopropylamino-n-butyl (meth)acrylamide, N-n-butylamino-n-butyl (meth)acrylamide, and N-isobutylamino-n-butyl (meth)acrylamide; dialkylamino (meth)acrylamides, such as N,N-dimethyl (meth)acrylamide, N,N-diethyl (meth)acrylamide, N,N-diisopropyl (meth)acrylamide, and N,N-di-n-butyl (meth)acrylamide; dialkylaminoalkyl (meth)acrylamides, such as N,N-dimethylaminoethyl (meth) acrylamide, N,N-diethylaminoethyl (meth)acrylamide, N,N-dimethylaminopropyl (meth)acrylamide, and N,N-di-n-butylaminobutyl (meth)acrylamide; and N-vinylcarboxylic acid amides, such as N-vinylformamide, N-vinylacetamide, N-vinyl-n-propionylamide, N-vinylisopropionylamide, and N-vinylhydroxyacetamide.

Examples of the nitro group-containing monomer (x2-c2) include nitroethylene and 3-nitro-1-propene.

Examples of the primary amino group-containing vinyl monomer (x2-c3) include alkenylamines having an alkenyl group having 3 to 6 carbon atoms, such as (meth)allylamine and crotylamine; and aminoalkyl (meth)acrylates having an alkyl group having 2 to 6 carbon atoms, such as aminoethyl (meth)acrylate.

Examples of the secondary amino group-containing vinyl monomer (x2-c4) include monoalkylaminoalkyl (meth) acrylates, such as t-butylaminoethyl (meth)acrylate and methylaminoethyl (meth)acrylate; and dialkenylamines having 6 to 12 carbon atoms, such as di(meth)allylamine.

Examples of the tertiary amino group-containing vinyl monomer (x2-c5) include dialkylaminoalkyl (meth)acrylates, such as dimethylaminoethyl (meth)acrylate and diethylaminoethyl (meth)acrylate; alicyclic (meth)acrylates having a nitrogen atom, such as morpholinoethyl (meth) acrylate; and hydrochlorides, sulfates, phosphates, or lower alkyl (carbon number: 1 to 8) monocarboxylic acid (e.g., acetic acid and propionic acid) salts thereof.

Examples of the nitrile group-containing vinyl monomer (x2-c6) include (meth)acrylonitrile.

In the comb-shaped polymer (B1) that is used in one embodiment of the present invention, it is preferred that the content of the structural unit derived from the nitrogen atom-containing vinyl monomer (x2-c) is as small as possible.

Specifically, the content of the structural unit derived from the nitrogen atom-containing vinyl monomer (x2-c) is preferably less than 1.0 mol %, more preferably less than 0.5 mol %, still more preferably less than 0.1 mol %, yet still more preferably less than 0.01 mol %, and especially preferably 0 mol % on the basis of the whole amount (100 mol %) of the structural unit of the comb-shaped polymer (B1).

(Hydroxy Group-Containing Vinyl Monomer (x2-d))

Examples of the hydroxy group-containing vinyl monomer (x2-d) include a hydroxy group-containing vinyl monomer (x2-d1) and a polyoxyalkylene chain-containing vinyl monomer (x2-d2).

Examples of the hydroxy group-containing vinyl monomer (x2-d1) include hydroxyalkyl (meth)acrylates having an alkyl group having 2 to 6 carbon atoms, such as 2-hydroxyethyl (meth)acrylate and 2- or 3-hydroxypropyl (meth)acrylate; mono- or di-hydroxyalkyl-substituted (meth)acrylamides having an alkyl group having 1 to 4 carbon atoms, such as N,N-dihydroxymethyl (meth)acrylamide, N,N-dihydroxypropyl (meth)acrylamide, and N,N-di-2-hydroxybutyl (meth)acrylamide; vinyl alcohol; alkenols having 3 to 12 carbon atoms, such as (meth)allyl alcohol, crotyl alcohol, isocrotyl alcohol, 1-octenol, and 1-undecenol; alkene monools or alkene diols each having 4 to 12 carbon atoms, such as 1-buten-3-ol, 2-buten-1-ol, and 2-butene-1,4-diol; hydroxyalkyl alkenyl ethers having an alkyl group having 1 to 6 carbon atoms and an alkenyl group having 3 to 10 carbon atoms, such as 2-hydroxyethyl propenyl ether; compounds in which an unsaturated group, such as an alkenyl group and the aforementioned polymerizable functional group which the macromonomer (x1) has is introduced into a polyhydric alcohol, such as glycerin, pentaerythritol, sorbitol, sorbitan, diglycerin, a sugar, and sucrose; and compounds in which an unsaturated group, such as an alkenyl group and the aforementioned polymerizable functional group which the macromonomer (x1) has is introduced into glyceric acid or a glycerin fatty acid ester.

Of these, hydroxy group-containing vinyl monomers having two or more hydroxy groups are preferred, and compounds in which the aforementioned unsaturated group is introduced into a polyhydric alcohol or glyceric acid are more preferred.

Examples of the polyoxyalkylene chain-containing vinyl monomer (x2-d2) include a polyoxyalkylene glycol (carbon number of the alkylene group: 2 to 4, degree of polymerization: 2 to 50), a polyoxyalkylene polyol (polyoxyalkylene ether of the aforementioned polyhydric alcohol (carbon number of the alkylene group: 2 to 4, degree of polymerization: 2 to 100)), and a compound in which the aforementioned unsaturated group is introduced into a compound selected from alkyl (carbon number: 1 to 4) ethers of a polyoxyalkylene glycol or a polyoxyalkylene polyol.

Specifically, examples thereof include polyethylene glycol (Mn: 100 to 300) mono(meth)acrylate, polypropylene glycol (Mn: 130 to 500) mono(meth)acrylate, methoxypolyethylene glycol (Mn: 110 to 310) (meth)acrylate, lauryl alcohol ethylene oxide adduct (2 to 30 mols) (meth)acrylate, and mono(meth)acrylic acid polyoxyethylene (Mn: 150 to 230) sorbitan.

The content of the structural unit derived from the hydroxy group-containing vinyl monomer (x2-d) is preferably 0.1 to 30 mol %, more preferably 0.5 to 20 mol %, still more preferably 1 to 15 mol %, and yet still more preferably 3 to 10 mol % on the basis of the whole amount (100 mol %) of the structural unit of the comb-shaped polymer (B1).

(Phosphorus Atom-Containing Monomer (x2-e))

Examples of the phosphorus atom-containing monomer (x2-e) include a phosphate ester group-containing monomer (x2-e1) and a phosphono group-containing monomer (x2-e2).

Examples of the phosphate ester group-containing monomer (x2-e1) include (meth)acryloyloxyalkyl phosphates having an alkyl group having 2 to 4 carbon atoms, such as (meth)acryloyloxyethyl phosphate and (meth)acryloyloxyisopropyl phosphate; and alkenyl phosphates having an alkenyl group having 2 to 12 carbon atoms, such as vinyl phosphate, allyl phosphate, propenyl phosphate, isopropenyl phosphate, butenyl phosphate, pentenyl phosphate, octenylphosphate, decenylphosphate, and dodecenylphosphate.

Examples of the phosphono group-containing monomer (x2-e2) include (meth)acryloyloxyalkyl phosphonates having an alkyl group having 2 to 4 carbon atoms, such as (meth)acryloyloxyethyl phosphonate; and alkenyl phosphonates having an alkenyl group having 2 to 12 carbon atoms, such as vinyl phosphonate, allyl phosphonate, and octenyl phosphonate.

In the comb-shaped polymer (B1) that is used in one embodiment of the present invention, it is preferred that the content of the structural unit derived from the phosphorus atom-containing monomer (x2-e) is as small as possible.

Specifically, the content of the structural unit derived from the phosphorus atom-containing monomer (x2-e) is preferably less than 1.0 mol %, more preferably less than 0.5 mol %, still more preferably less than 0.1 mol %, yet still more preferably less than 0.01 mol %, and especially preferably 0 mol % on the basis of the whole amount (100 mol %) of the structural unit of the comb-shaped polymer (B1).

(Aliphatic Hydrocarbon-Based Vinyl Monomer (x2-f))

Examples of the aliphatic hydrocarbon-based vinyl monomer (x2-f) include alkenes having 2 to 20 carbon atoms, such as ethylene, propylene, butene, isobutylene, pentene, heptene, diisobutylene, octene, dodecene, and octadecene; and alkadienes having 4 to 12 carbon atoms, such as butadiene, isoprene, 1,4-pentadiene, 1,6-heptadiene, and 1,7-octadiene.

The carbon number of the aliphatic hydrocarbon-based vinyl monomer (x2-f) is preferably 2 to 30, more preferably 2 to 20, and still more preferably 2 to 12.

(Alicyclic Hydrocarbon-Based Vinyl Monomer (x2-g))

Examples of the alicyclic hydrocarbon-based vinyl monomer (x2-g) include cyclohexene, (di)cyclopentadiene, pinene, limonene, vinylcyclohexene, and ethylidenebicycloheptene.

The carbon number of the alicyclic hydrocarbon-based vinyl monomer (x2-g) is preferably 3 to 30, more preferably 3 to 20, and still more preferably 3 to 12.

(Vinyl Ester (x2-h))

Examples of the vinyl ester (x2-h) include vinyl esters of a saturated fatty acid having 2 to 12 carbon atoms, such as vinyl acetate, vinyl propionate, vinyl butyrate, and vinyl octanoate.

(Vinyl Ether (x2-i))

Examples of the vinyl ether (x2-i) include alkyl vinyl ethers having 1 to 12 carbon atoms, such as methyl vinyl ether, ethyl vinyl ether, propyl vinyl ether, butyl vinyl ether, and 2-ethylhexyl vinyl ether; and alkoxyalkyl vinyl ethers having 1 to 12 carbon atoms, such as vinyl-2-methoxyethyl ether and vinyl-2-butoxyethyl ether.

(Vinyl Ketone (x2-j))

Examples of the vinyl ketone (x2-j) include alkyl vinyl ketones having 1 to 8 carbon atoms, such as methyl vinyl ketone and ethyl vinyl ketone.

(Epoxy Group-Containing Vinyl Monomer (x2-k))

Examples of the epoxy group-containing vinyl monomer (x2-k) include glycidyl (meth)acrylate and glycidyl (meth) allyl ether.

(Halogen Element-Containing Vinyl Monomer (x2-1))

Examples of the halogen element-containing vinyl monomer (x2-1) include vinyl chloride, vinyl bromide, vinylidene chloride, and (meth)allyl chloride.

(Ester of Unsaturated Polycarboxylic Acid (x2-m))

Examples of the ester of unsaturated polycarboxylic acid (x2-m) include an alkyl ester of an unsaturated polycarboxylic acid, a cycloalkyl ester of an unsaturated polycarboxylic acid, and an aralkyl ester of an unsaturated polycarboxylic acid; and examples of the unsaturated carboxylic acid include maleic acid, fumaric acid, and itaconic acid.

((Di)Alkyl Fumarate (x2-n))

Examples of the (di)alkyl fumarate (x2-n) include monomethyl fumarate, dimethyl fumarate, monoethyl fumarate, diethyl fumarate, methylethyl fumarate, monobutyl fumarate, dibutyl fumarate, dipentyl fumarate, and dihexyl fumarate.

((Di)Alkyl Maleate (x2-o))

Examples of the (di)alkyl maleate (x2-o) include monomethyl maleate, dimethyl maleate, monoethyl maleate, diethyl maleate, methylethyl maleate, monobutyl maleate, and dibutyl maleate.

(Aromatic Hydrocarbon-Based Vinyl Monomer (x2-p))

Examples of the aromatic hydrocarbon-based vinyl monomer (x2-p) include styrene, α-methylstyrene, α-ethylstyrene, vinyltoluene, 2,4-dimethylstyrene, 4-ethylstyrene, 4-isopropylstyrene, 4-butylstyrene, 4-phenylstyrene, 4-cyclohexylstyrene, 4-benzylstyrene, p-methylstyrene, monochlorostyrene, dichlorostyrene, tribromostyrene, tetrabromostyrene, 4-crotylbenzene, indene, and 2-vinylnaphthalene.

The carbon number of the aromatic hydrocarbon-based vinyl monomer (x2-p) is preferably 8 to 30, more preferably 8 to 20, and still more preferably 8 to 18.

In the comb-shaped polymer (B1) that is used in one embodiment of the present invention, it is preferred that the content of the structural unit derived from the aromatic hydrocarbon-based vinyl monomer (x2-p) is as small as possible. Specifically, the content of the structural unit derived from the aromatic hydrocarbon-based vinyl monomer (x2-p) is preferably less than 1.0 mol %, more preferably less than 0.5 mol %, still more preferably less than 0.1 mol %, yet still more preferably less than 0.01 mol %, and especially preferably 0 mol % on the basis of the whole amount (100 mol %) of the structural unit of the comb-shaped polymer (B1).

<Organic Molybdenum-Based Compound (C)>

The lubricating oil composition of the present invention contains the organic molybdenum-based compound (C) as a friction modifier.

Since the lubricating oil composition of the present invention contains the aforementioned olefin-based polymer (A) as the base oil (A) and the comb-shaped polymer (B1) as the viscosity index improver (B), the friction-reducing effect by blending the component (C) is readily revealed.

In the lubricating oil composition according to one embodiment of the present invention, the content of the organic molybdenum-based compound (C) in terms of a molybdenum atom is preferably 400 to 1,000 ppm by mass, more preferably 500 to 950 ppm by mass, still more preferably 600 to 900 ppm by mass, and yet still more preferably 650 to 850 ppm by mass on the basis of the whole amount (100% by mass) of the lubricating oil composition.

In this specification, the content of the molybdenum atom means a value measured in conformity with JPI-5S-38-92.

In the lubricating oil composition according to one embodiment of the present invention, the content of the organic molybdenum-based compound (C) in terms of a molybdenum atom is preferably 1.0 to 10.0 parts by mass, more preferably 1.5 to 7.5 parts by mass, still more preferably 2.0 to 6.0 parts by mass, and yet still more preferably 2.5 to 5.0 parts by mass based on 100 parts by mass of the comb-shaped polymer (B1).

As the organic molybdenum-based (C) that is used in one embodiment of the present invention, though any organic compounds having a molybdenum atom are usable, a molybdenum dithiophosphate (MoDTP) and a molybdenum dithiocarbamate (MoDTC) are preferred from the viewpoint of improving the friction reducing effect.

The organic molybdenum-based compound (C) may be used alone or may be used in combination of two or more thereof.

As the molybdenum dithiophosphate (MoDTP), a compound represented by the following general formula (c1-1) or a compound represented by the following general formula (c1-2) is preferred.

(c1-1)

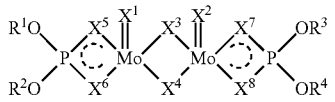

(c1-2)

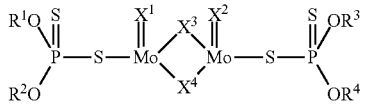

In the general formulae (c1-1) and (c1-2), $R^1$ to $R^4$ each independently represent a hydrocarbon group, and may be the same as or different from each other.

$X^1$ to $X^8$ each independently represent an oxygen atom or a sulfur atom, and may be the same as or different from each other, provided that at least two of $X^1$ to $X^8$ in the general formula (c1-1) are a sulfur atom.

In one embodiment of the present invention, in the general formula (c1-1), it is preferred that $X^1$ and $X^2$ are an oxygen atom, and $X^3$ to $X^8$ are a sulfur atom.

In the general formula (c1-1), from the viewpoint of improving the solubility, a molar ratio of the sulfur atom to the oxygen atom [(sulfur atom)/(oxygen atom)] in $X^1$ to $X^8$ is preferably 1/4 to 4/1, and more preferably 1/3 to 3/1.

In the general formula (c1-2), it is preferred that $X^1$ and $X^2$ are an oxygen atom, and $X^3$ and $X^4$ are a sulfur atom.

In the general formula (c1-2), from the same viewpoint as mentioned above, a molar ratio of the sulfur atom to the oxygen atom [(sulfur atom)/(oxygen atom)] in $X^1$ to $X^4$ is preferably 1/3 to 3/1, and more preferably 1.5/2.5 to 2.5/1.5.

The carbon number of the hydrocarbon group which may be selected as $R^1$ to $R^4$ is preferably 1 to 20, more preferably 5 to 18, still more preferably 5 to 16, and yet still more preferably 5 to 12.

Specifically, examples of the hydrocarbon group which may be selected as $R^1$ to $R^4$ include an alkyl group, such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecylgroup, a pentadecylgroup, ahexadecylgroup, aheptadecylgroup, and an octadecyl group; an alkenyl group, such as an octenyl group, a nonenyl group, a decenyl group, an undecenyl group, a dodecenyl group, a tridecenyl group, a tetradecenyl group, and a pentadecenyl group; a cycloalkyl group, such as a cyclohexyl group, a dimethylcyclohexyl group, an ethylcyclohexyl group, a methylcyclohexylmethyl group, a cyclohexylethyl group, a propylcyclohexyl group, a butylcyclohexyl group, and a heptylcyclohexyl group; an aryl group, such as a phenyl group, a naphthyl group, an anthracenyl group, a biphenyl group, and a terphenyl group; an alkylaryl group, such as a tolyl group, a dimethylphenyl group, a butylphenyl group, a nonylphenyl group, a methylbenzyl group, and a dimethylnaphthyl group; and an arylalkyl group, such as a phenylmethyl group, a phenylethyl group, and a diphenylmethyl group.

Examples of the molybdenum dithiocarbamate (MoDTC) include a binuclear molybdenum dithiocarbamate having two molybdenum atoms in one molecule thereof; and a trinuclear molybdenum dithiocarbamate having three molybdenum atoms in one molecule thereof, with a binuclear molybdenum dithiocarbamate being preferred.

As the binuclear molybdenum dithiocarbamate, a compound represented by the following general formula (c2-1) and a compound represented by the following general formula (c2-2) are more preferred.

(c2-1)

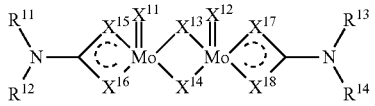

(c2-2)

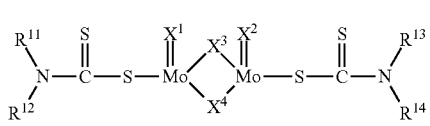

In the general formulae (c2-1) and (c2-2), $R^{11}$ to $R^{14}$ each independently represent a hydrocarbon group, and may be the same as or different from each other.

$X^{11}$ to $X^{18}$ each independently represent an oxygen atom or a sulfur atom, and may be the same as or different from each other.

However, at least one of $X^{11}$ to $X^{18}$ in the formula (c2-1) is a sulfur atom.

In one embodiment of the present invention, in the formula (c2-1), it is preferred that $X^{11}$ and $X^{12}$ are an oxygen atom, and $X^{13}$ to $X^{18}$ are a sulfur atom.

In the general formula (c2-1), from the viewpoint of improving the solubility in the base oil (A), a molar ratio of the sulfur atom to the oxygen atom [(sulfur atom)/(oxygen atom)] in $X^{11}$ to $X^{18}$ is preferably 1/4 to 4/1, and more preferably 1/3 to 3/1.

It is preferred that $X^{11}$ to $X^{14}$ in the formula (b2-2) are an oxygen atom.

In the general formulae (c2-1) and (c2-2), the carbon number of the hydrocarbon group which may be selected as $R^{11}$ to $R^{14}$ is preferably 1 to 20, more preferably 5 to 18, still more preferably 5 to 16, and yet still more preferably 5 to 13.

As the specific hydrocarbon group which may be selected as $R^{11}$ to $R^{14}$, there are exemplified the same hydrocarbon groups as the hydrocarbon groups which may be selected as $R^1$ to $R^4$ in the general formulae (c1-1) and (c1-2).

<Additive for Lubricating Oil>

The lubricating oil composition according to one embodiment of the present invention may further contain an additive for lubricating oil other than the components (B) and (C), if desired, within a range where the effects of the present invention are not impaired. The additive for lubricating oil other than the components (B) and (C) is hereinafter also referred to simply as "additive for lubricating oil".

Examples of such an additive for lubricating oil include a pour-point depressant, a metal-based detergent, a dispersant, an anti-wear agent, an extreme pressure agent, an antioxidant, an anti-foaming agent, a rust inhibitor, and a metal deactivator.

A commercially available additive package containing a plurality of additives and meeting API/ILSAC SN/GF-5 standards or the like may be used as the additive for lubricating oil.

A compound having plural functions as the additive (for example, a compound having functions as an anti-wear agent and an extreme pressure agent) may also be used.

Furthermore, the respective additives for lubricating oil may be used alone or may be used in combination of two or more thereof.

Although the content of each of such additives for lubricating oil can be appropriately regulated within a range where the effects of the present invention are not impaired, it is typically 0.001 to 15% by mass, preferably 0.005 to 10% by mass, and more preferably 0.01 to 8% by mass on the basis of the whole amount (100% by mass) of the lubricating oil composition.

In the lubricating oil composition according to one embodiment of the present invention, the total content of these additives for lubricating oil is preferably 0 to 40% by mass, more preferably 0 to 30% by mass, still more preferably 0 to 20% by mass, and yet still more preferably 0 to 15% by mass on the basis of the whole amount (100% by mass) of the lubricating oil composition.

The lubricating oil composition according to one embodiment of the present invention may contain a friction modifier which is not corresponding to the component (C).

Examples of the friction modifier include ash-free friction modifiers, such as an aliphatic amine, a fatty acid ester, a fatty acid amide, a fatty acid, an aliphatic alcohol, and an aliphatic ether, each having at least one alkyl group or alkenyl group having 6 to 30 carbon atoms in a molecule thereof; oils and fats; amines; amides; sulfurized esters; phosphoric acid esters; phosphorous acid esters; and phosphoric acid ester amine salts.

The content of the friction modifier which is not corresponding to the component (C) is preferably 0 to 30 parts by mass, more preferably 0 to 20 parts by mass, and still more preferably 0 to 10 parts by mass based on 100 parts by mass of the whole amount of the component (C).

<Various Physical Properties of Lubricating Oil Composition>

The kinetic viscosity at 100° C. of the lubricating oil composition according to one embodiment of the present invention is preferably 2.0 to 10.0 $mm^2/s$, more preferably 2.5 to 8.5 $mm^2/s$, still more preferably 3.0 to 7.0 $mm^2/s$, and yet still more preferably 3.5 to 6.0 $mm^2/s$.

The kinetic viscosity at 50° C. of the lubricating oil composition according to one embodiment of the present invention is preferably 5.0 to 14.7 $mm^2/s$, more preferably 6.5 to 14.5 $mm^2/s$, still more preferably 8.0 to 14.0 $mm^2/s$, and yet still more preferably 9.5 to 13.0 $mm^2/s$.

The kinetic viscosity at 40° C. of the lubricating oil composition according to one embodiment of the present invention is preferably 6.0 to 22.0 $mm^2/s$, more preferably 7.0 to 20.0 $mm^2/s$, still more preferably 8.0 to 19.0 $mm^2/s$, yet still more preferably 10.0 to 17.0 $mm^2/s$, and even yet still more preferably 11.0 to 16.0 $mm^2/s$.

The viscosity index of the lubricating oil composition according to one embodiment of the present invention is preferably 120 or more, more preferably 140 or more, still more preferably 170 or more, yet still more preferably 190 or more, even yet still more preferably 210 or more, and even still more preferably 230 or more.

With respect to the lubricating oil composition according to one embodiment of the present invention, the coefficient of friction measured with a high-frequency reciprocating rig (HFRR) tester under conditions described in the section of Examples as mentioned later is preferably 0.115 or less, more preferably 0.100 or less, still more preferably 0.090 or less, yet still more preferably 0.085 or less, even still more preferably 0.080 or less, and even still more preferably 0.078 or less.

[Production Method of Lubricating Oil Composition]

Although the method for producing the lubricating oil composition of the present invention is not particularly limited, a production method including the following step (1) is preferred.

Step (1): A step of blending a base oil (A) containing the olefin-based polymer (A1) with the viscosity index improver (B) containing the comb-shaped polymer (B1) and the organic molybdenum-based compound (C), thereby preparing the lubricating oil composition such that the content of the comb-shaped polymer (B1) is 0.30% by mass or more on the basis of the whole amount of the lubricating oil composition.

In the step (1), the olefin-based polymer (A1) and the base oil (A), the comb-shaped polymer (B1) and the viscosity index improver (B), and the organic molybdenum compound (C) are those as mentioned above, and the preferred components and the contents of the respective components are also those as mentioned above.

In the present step, the aforementioned additives for lubricating oil other than the components (B) and (C) may also be blended.

The viscosity index improver (B) containing the comb-shaped polymer (B1) may be blended in a form of a solution dissolved in a diluent oil. The solid component concentration of the solution is typically 10 to 50% by mass.

It is preferred that after blending the respective components, the resulting blend is stirred and uniformly dispersed by a known method.

[Application of Lubricating Oil Composition]

The lubricating oil composition of the present invention is one which when used in both a high-temperature environment at around 150° C. and a low-temperature environment at around 50° C., exhibits excellent fuel consumption reducing properties and also has an excellent friction reducing effect, while achieving low evaporativity.

Accordingly, the lubricating oil composition according to one embodiment of the present invention is preferably used for internal combustion engines of vehicles, such as automobiles, electric trains, and aircrafts, and in particular, it is more preferably used for an internal combustion engine of hybrid car.

The lubricating oil composition according to one embodiment of the present invention is suited for lubrication for a sliding mechanism equipped with a piston ring and a liner in a device having a sliding mechanism having a piston ring and a liner, particularly a sliding mechanism equipped with a piston ring and a liner in an internal combustion engine (preferably, an internal combustion engine of hybrid car).

A material for forming the piston ring or liner to which the lubricating oil composition of the present invention is applied is not particularly limited.

Examples of a piston ring-forming material include a Si—Cr steel and a martensite-based stainless steel containing 11 to 17% by mass of chromium. Preferably, the piston ring-forming material is subjected to a substrate treatment according to a chromium plating treatment, a chromium nitride treatment, a nitriding treatment, or a combination thereof.

Examples of a liner-forming material include an aluminum alloy and a cast iron alloy.

[Internal Combustion Engine]

The present invention also provides an internal combustion engine having a sliding mechanism equipped with a piston ring and a liner and including the aforementioned lubricating oil composition of the present invention.

In one embodiment of the present invention, an internal combustion engine in which the lubricating oil composition of the present invention is applied to a sliding portion of the aforementioned sliding mechanism is preferred.

The lubricating oil composition of the present embodiment and the sliding mechanism equipped with a piston ring and a liner are those as mentioned above, and as a specific configuration of the sliding mechanism, there is exemplified one shown in FIG. 1.

A sliding mechanism 1 shown in FIG. 1 includes a block 2 having a piston travel path 2*a* and a crank shaft housing 2*b*, a liner 12 disposed along the inner wall of the piston travel path 2*a*, a piston 4 housed inside the liner 12, piston rings 6 fitted around the piston 4, a crank shaft 10 housed inside the crank shaft housing 2*b*, a con'rod 9 that connects the crank shaft 10 to the piston 4, and a structure interposed between the liner 12 and the piston travel path 2*a*.

The crank shaft 10 is rotatably driven by a non-illustrated motor and enables the piston 4 to make a reciprocating motion via the con'rod 9.

In the sliding mechanism 1 of such a configuration, a lubricating oil composition 20 of the present invention is charged into the crank shaft housing 2*b* until the liquid level is above the center of the central axis of the crank shaft 10 and below the uppermost end of the central axis. The lubricating oil composition 20 in the crank shaft housing 2*b* is supplied between the liner 12 and the piston rings 6 by being splashed with the rotating crank shaft 10.

[Lubrication Method of Internal Combustion Engine]

The present invention also provides a lubrication method of an internal combustion engine for lubricating a device having a sliding mechanism equipped with a piston ring and a liner, the method including lubricating the piston ring and the liner with the aforementioned lubricating oil composition of the present invention.

The lubricating oil composition of the present embodiment and the sliding mechanism equipped with a piston ring and a liner are those as mentioned above.

In the lubrication method of an internal combustion engine of the present invention, by using the lubricating oil composition of the present embodiment as a lubricating oil for the sliding portion between the piston ring and the liner, the friction is greatly reduced in both fluid lubrication and mixed lubrication, thereby enabling one to contribute to an improvement of the fuel consumption reducing properties.

EXAMPLES

The present invention is hereunder described in more detail by reference to Examples, but it should be construed that the present invention is by no means limited by the following Examples. The measurement methods and evaluation methods of various physical properties are as follows.

(1) Kinetic Viscosities at 40° C., 50° C., and 100° C.

The kinematic viscosity at 40° C. or 100° C. was measured in conformity with JIS K2283:2000.

In addition, the kinematic viscosity at 50° C. was calculated on the basis of the kinematic viscosities at 40° C. and 100° C.

(2) Viscosity Index

The calculation was performed in conformity with JIS K2283:2000.

(3) Flash Point

The measurement was performed in conformity with JIS K2265-4 (COC method).

(4) Pour Point

The measurement was performed in conformity with JIS K2269.

(5) Weight Average Molecular Weight (Mw) and Number Average Molecular Weight (Mn)

The measurement was performed by using a gel permeation chromatography device ("1260 Type HPLC", manufactured by Agilent) under the following conditions, and the values measured in terms of a standard polystyrene conversion were adopted.

(Measurement Conditions)

Column: Two "Shodex LF404" columns connected in series

Column temperature: 35° C.

Developing solvent: Chloroform

Flow rate: 0.3 mL/min (6) Content of Molybdenum Atom

The measurement was performed in conformity with JPI-5S-38-92.

(7) SSI (Shear Stability Index)

To a viscosity index improver to be measured, a mineral oil that is a diluent oil was added to prepare a sample oil, and the SSI was measured using the sample oil and the mineral oil in conformity with ASTM D6278.

Specifically, with respect to the viscosity index improver to be measured, each of $Kv_0$, $Kv_1$, and $Kv_{oil}$ values in the aforementioned calculation formula (1) was measured and calculated according to the calculation formula (1).

As a high-shear diesel injector for 30 cycles, a high-shear Bosch diesel injector for 30 cycles was used.

(8) HTHS Viscosity at 50° C. or 150° C.

After shearing a lubricating oil composition to be measured at a shear rate of $10^6$/s under temperature conditions at 40° C., 100° C., or 150° C., the viscosity was measured in conformity with ASTM D4741.

Then, the HTHS viscosity at 50° C. was calculated on the basis of the HTHS viscosities at 40° C. and 100° C.

(9) NOACK Value

The measurement was performed under conditions at 250° C. for 1 hour in conformity with JPI-5S-41-2004.

(10) Coefficient of Friction

The coefficient of friction at 80° C. of each lubricating oil composition was measured with an HFRR tester (manufactured by PCS Instruments) under the following conditions.

Test piece: Disk (material: SUJ-2, diameter: 10 mm, thickness: 3.0 mm), ball (material: SUJ-2, diameter: 6.0 mm)

Amplitude: 1.0 mm

Frequency: 50 Hz (speed: 0.16 m/s)

Load: 200 g

Temperature: 80° C.

Test time: 15 minutes

Production Example 1 (Formation of Hydride of Decene Trimer)

(1) Polymerization of 1-Decene

In a three-necked flask having an internal volume of 5 liters, 4 liters (21.4 mol) of 1-decene (a trade name: "Linealene 10", manufactured by Idemitsu Kosan Co., Ltd.) was added, and then, a solution of biscyclopentadienyl zirconium dichloride (complex mass: 1,168 mg (4 mmol)) as a metallocene catalyst dissolved in toluene and a solution of methylalumoxane (40 mmol in terms of Al) dissolved in toluene were further added.

After the addition, the contents were stirred at 40° C. for 20 hours to advance oligomerization of the decene monomer, and then, 20 mL of methanol was added, thereby terminating the oligomerization reaction.

Subsequently, the reaction mixture was taken out from the three-necked flask, 4 liters of a 5 mol/L sodium hydroxide aqueous solution was added, and the contents were stirred at room temperature (25° C.) for 4 hours to achieve a liquid separation operation. Then, an organic layer as an upper layer was taken out to obtain a solution of a decene trimer.

(2) Hydrogenation Treatment

In an autoclave having an internal volume of 5 liters, 3 liters of the solution of the decene oligomer obtained in the above (1) was added in a nitrogen stream, and then, a solution of cobalt trisacetyl acetonate (catalyst mass: 3.0 g) dissolved in toluene and a solution of triisobutylaluminum (30 mmol) dissolved in toluene were further added.

After the addition, the system was purged twice with hydrogen, the temperature was raised, and the contents were held at a reaction temperature of 80° C. under a hydrogen pressure of 0.9 MPa, thereby advancing the hydrogenation reaction. Then, the temperature was dropped to room temperature (25° C.) for 4 hours after commencement of the reaction, thereby terminating the hydrogenation reaction.

Subsequently, depressurization was performed, the reaction product within the autoclave was taken out, and a fraction having a distillation temperature of 240 to 270° C. and a pressure of 530 Pa was separated by means of simple distillation, thereby obtaining an olefin-based polymer composed of a hydride of the decene trimer.

The olefin-based polymer obtained was analyzed by means of the following gas chromatograph. As a result, a chromatogram shown in FIG. 2 was obtained.

[Measurement Conditions of Gas Chromatograph]

Column: Dexsil 300GC 3% (Chromosorb WAW DMCS), 1.5 m×3 m

Carrier gas: $N_2$ gas, 45 mL/min

Column head pressure: 120 kPa (360° C.)

Injection port: Splitless, temperature: 360° C.

Column temperature: 100 to 350° C. (to raise the temperature from 100° C. to 350° C. at a temperature rise rate of 10° C./min)

Detector: FID (temperature: 360° C.)

Figure 2:
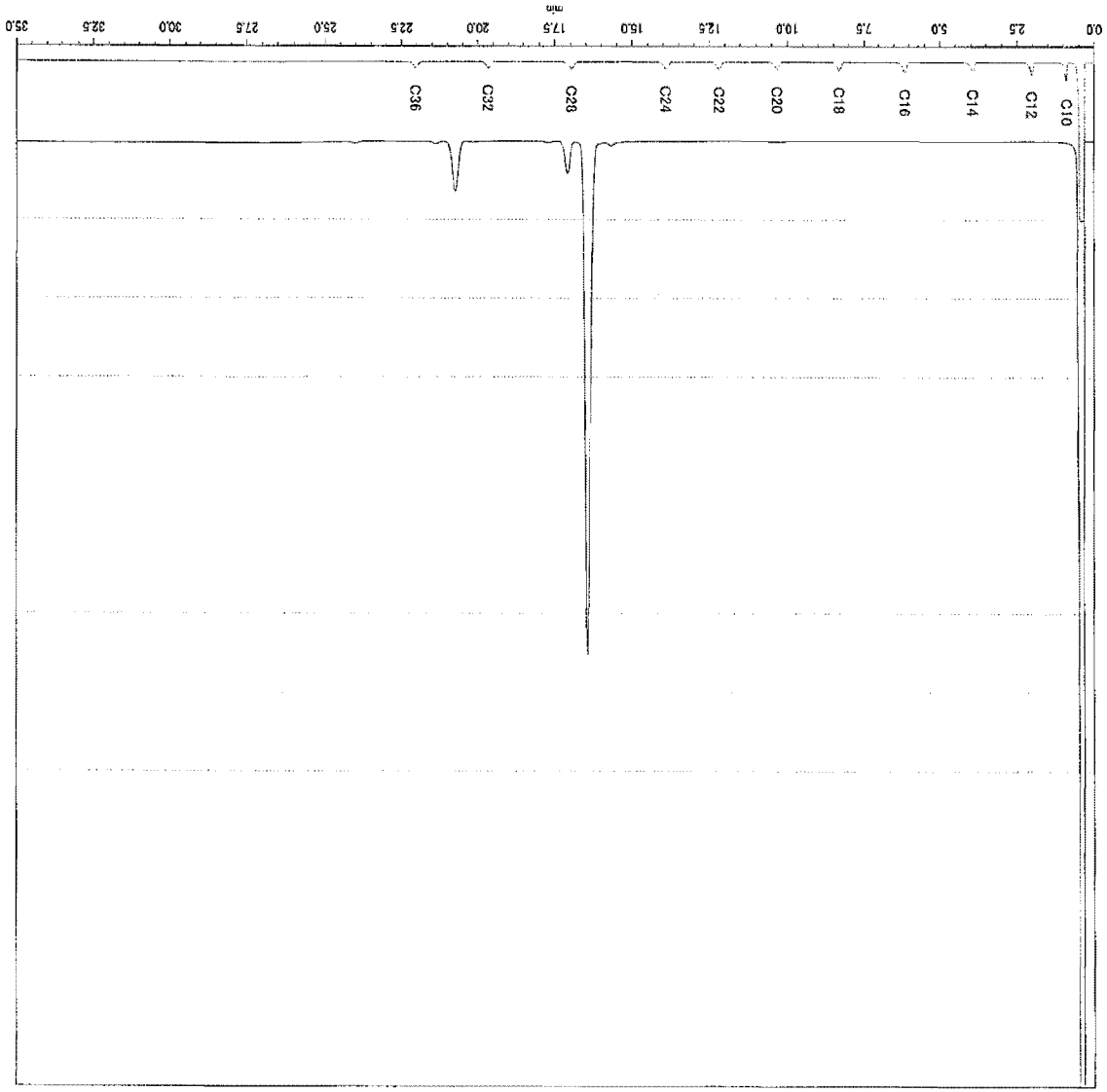
FIG. 2 is a chromatogram obtained on analyzing a base oil (a-1) that is an olefin-based polymer synthetized in Production Example 1 by a gas chromatograph.

An area ratio of a peak derived from the hydride of the decene trimer (retention time in FIG. 2: 16 to 17 minutes) relative to 100% of a total area of peaks detected in the chromatogram shown in FIG. 2 was 86%.

Various physical properties of the olefin-based polymer obtained were as follows.

Kinematic viscosity at 40° C.=13.61 $mm^2/s$, kinematic viscosity at 100° C.=3.42 $mm^2/s$, viscosity index=129, flash point=232° C., pour point=lower than −50° C.

Examples 1 to 4 and Comparative Examples 1 to 5

A base oil, a viscosity index improver, a friction modifier, and an additive package of the kinds and blending amounts shown in Table 1 were blended, thereby preparing lubricating oil compositions, respectively. The blending amount of each of the viscosity index improver, the friction modifier, and the additive package shown in Table 1 is a blending amount of the active component (solid component) in which a diluent oil is eliminated.

Then, the various physical properties of the lubricating oil compositions were measured on the basis of the aforementioned methods. These results are shown in Table 1.

Details of the used base oil, viscosity index improver, friction modifier, and additive package are as follows.

The base oil (a-3) and the base oil (a-4) were analyzed by a gas chromatograph in the same manner as described above. As a result, chromatograms shown in FIGS. 3 and 4 were obtained, respectively.

Figure 3:
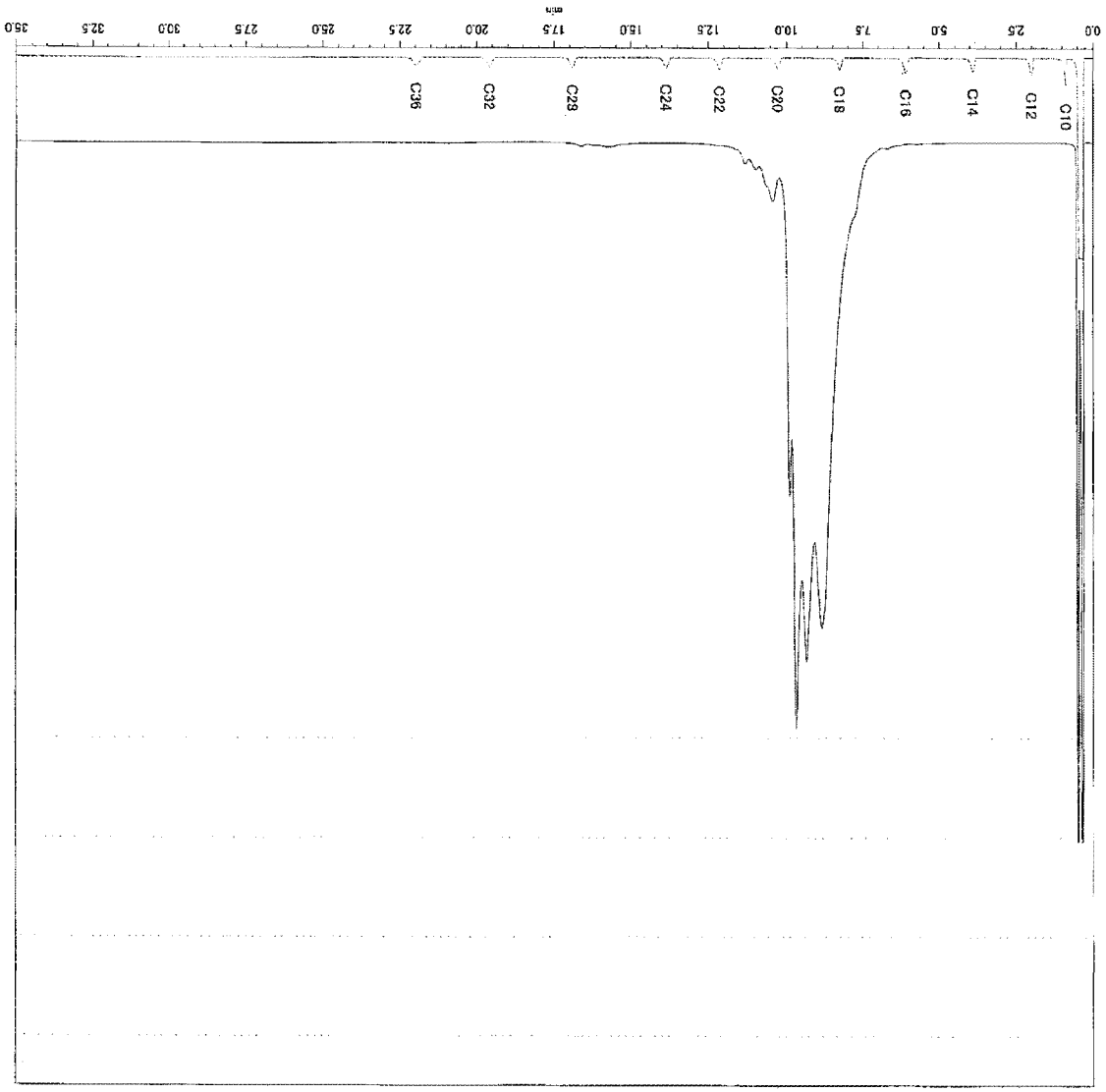
FIG. 3 is a chromatogram obtained on analyzing a base oil (a-3) by a gas chromatograph.
Figure 4:
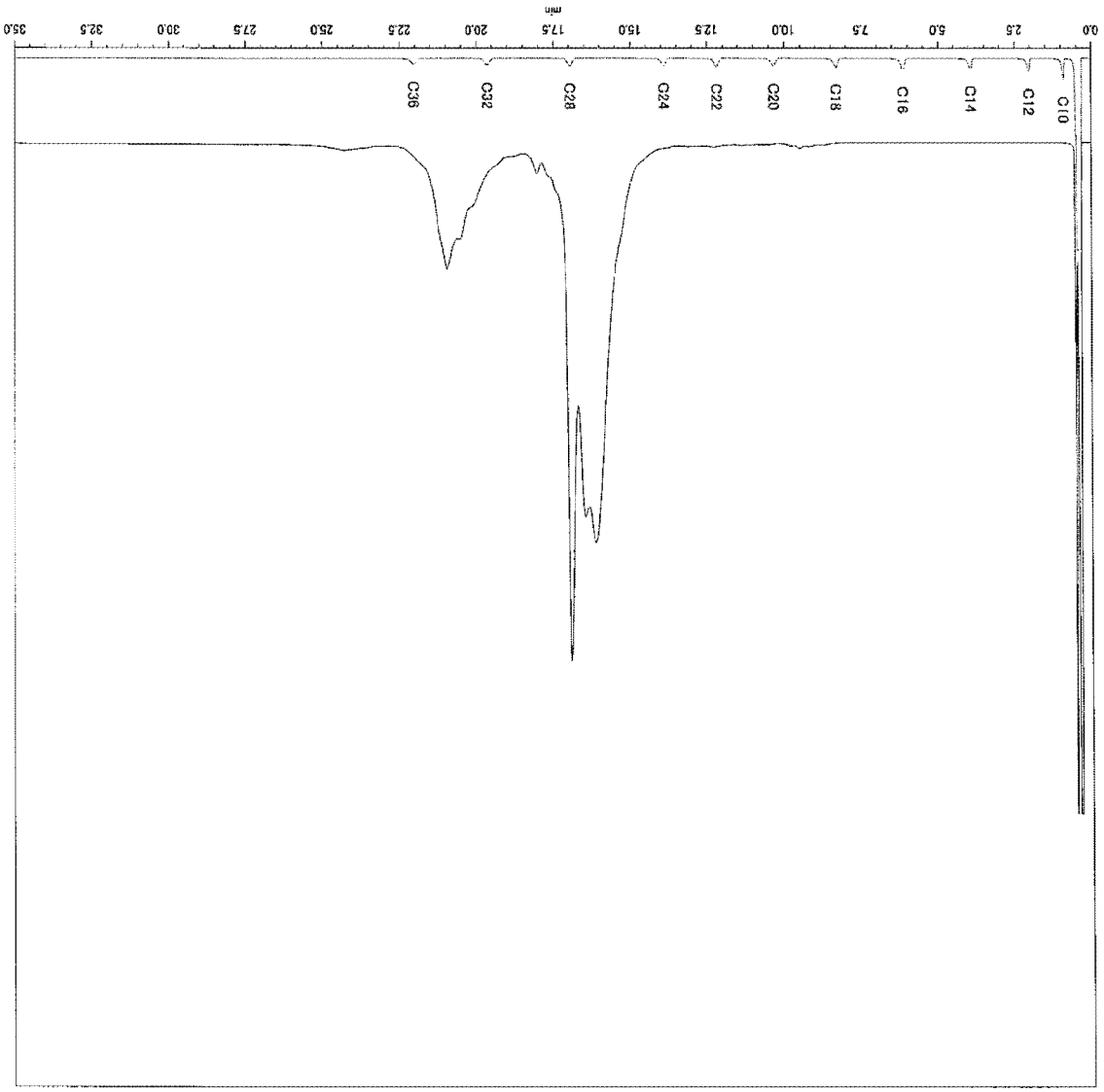
FIG. 4 is a chromatogram obtained on analyzing a base oil (a-4) by a gas chromatograph.

The "area ratio of a peak derived from the hydride of the decene trimer" of each of the base oil (a-3) and the base oil (a-4) expresses an area ratio of a peak derived from the hydride of the decene trimer relative to 100% of a total area of peaks detected in the chromatogram shown in FIGS. 3 and 4 (retention time in FIGS. 3 and 4: 16 to 17 minutes).

<Base Oil>

Base oil (a-1): The olefin-based polymer obtained in Production Example 1, which is corresponding to the component (A1).

Base oil (a-2): An ether compound represented by the general formula (2), wherein $R^a$ is a n-octyl group, $R^b$ is a n-octyl group, and $R^c$ is a n-decyl group, kinematic viscosity at 100° C.=3.0 $mm^2/s$, viscosity index=142, pour point=−30° C. This is corresponding to the component (A2).

Base oil (a-3): A poly-α-olefin oligomer synthesized from 1-decene as the raw material monomer by using a BFs catalyst, kinematic viscosity at 40° C.=5 $mm^2/s$, kinematic viscosity at 100° C.=1.7 $mm^2/s$, flash point=150° C., area ratio of a peak derived from the hydride of the decene trimer (retention time in FIG. 3: 16 to 17 minutes)=0%.

Base oil (a-4): A poly-α-olefin oligomer synthesized from 1-decene as the raw material monomer by using a BFs catalyst, kinematic viscosity at 40° C.=17 $mm^2/s$, viscosity index=123, flash point=222° C., area ratio of a peak derived from the hydride of the decene trimer (retention time in FIG. 4: 16 to 17 minutes)=20%.

<Viscosity Index Improver>

Comb-shaped polymer: A comb-shaped polymer having a structural unit derived from (butyl (meth)acrylate)/(alkyl (meth)acrylate having a linear alkyl group having 12 to 18 carbon atoms)/(compound having the aforementioned unsaturated group introduced into glyceric acid)/(macromonomer)=79/12/8/1 (molar ratio). The macromonomer has a Mn of 5,000 to 6,000, and the content of the structural unit derived from isobutylene and/or 1,2-butylene in the whole of structural units (100 mol %) of the macromonomer is 65 mol %. Mw of the comb-shaped polymer=600,000, SSI=0.9. This is corresponding to the component (B).

PMA: Polymethacrylate (a product name: "VISCOPLEX 8-810", manufactured by Evonik Industries AG), SSI=31.

<Friction Modifier>

Organic Mo-based compound: ADEKA SAKURA-LUBE 515 (manufactured by Adeka Corporation); content of molybdenum atom=10.0% by mass; content of sulfur atom=11.5% by mass. A binuclear molybdenum dialkyldithiocarbamate represented by the following formula, which is corresponding to the component (C).

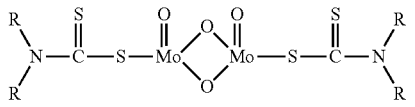

In the formula, R's are each independently a hydrocarbon group having a carbon number of 8 or 13.

<Other Additive>

Additive PKG for engine oil: An additive package adapted to the API/ILSAC standards and the SN/GF-5 standards and containing the following various additives.

Metal-based detergent: Calcium salicylate

Dispersant: Macromolecular bisimide and boron-modified monoimide

Anti-wear agent: Primary ZnDTP and secondary ZnDTP

Antioxidant: Diphenylamine-based antioxidant and hindered phenol-based antioxidant Metal deactivator: Benzotriazole Anti-foaming agent: Silicone-based anti-foaming agent

TABLE 1

| | | | | Example 1 | Example 2 | Example 3 | Example 4 | Comparative Example 1 |
|---|---|---|---|---|---|---|---|---|
| Composition | Base oil | Base oil (a-1) | mass % | 84.13 | 64.42 | 44.67 | 24.89 | — |
| | | Base oil (a-2) | mass % | — | 20.52 | 41.08 | 61.67 | 87.37 |
| | | Base oil (a-3) | mass % | 5.50 | 4.58 | 3.65 | 2.73 | 1.80 |
| | | Base oil (a-4) | mass % | — | — | — | — | — |
| | Viscosity index improver | Comb-shaped polymer | mass % | 0.57 | 0.68 | 0.80 | 0.91 | 1.03 |
| | | PMA | mass % | — | — | — | — | — |
| | Friction modifier | Organic Mo-based compound | mass % | 0.70 | 0.70 | 0.70 | 0.70 | 0.70 |
| | Other additive | Additive PKG for engine oil | mass % | 9.10 | 9.10 | 9.10 | 9.10 | 9.10 |
| | — | Total | mass % | 100.00 | 100.00 | 100.00 | 100.00 | 100.00 |
| | Content of base oil (a-1) on the basis of the whole amount (100% by mass) of the base oil | | mass % | 93.9 | 72.0 | 50.0 | 27.9 | 0 |
| | Content of base oil (a-2) based on 100 parts by mass of base oil (a-1) | | parts by mass | 0 | 31.9 | 92.0 | 247.8 | — |
| | Content of Mo atom | | ppm by mass | 700 | 700 | 700 | 700 | 700 |
| Various physical properties | Kinematic viscosity at 40° C. | | $mm^2/s$ | 18.76 | 17.72 | 16.69 | 15.65 | 14.62 |
| | Kinematic viscosity at 50° C. | | $mm^2/s$ | 13.79 | 13.22 | 12.65 | 12.06 | 11.46 |
| | Kinematic viscosity at 100° C. | | $mm^2/s$ | 4.53 | 4.55 | 4.57 | 4.59 | 4.60 |
| | Viscosity index | | — | 165 | 192 | 219 | 246 | 273 |
| | HTHS viscosity at 150° C. | | mPa · s | 1.7 | 1.7 | 1.7 | 1.7 | 1.7 |
| | HTHS viscosity at 50° C. | | mPa · s | 12.1 | 11.4 | 10.6 | 9.9 | 9.2 |
| | NOACK value (250° C., 1 h) | | mass % | 14.5 | 14.5 | 14.5 | 14.4 | 14.4 |
| | Coefficient of friction (HFRR tester) | | — | 0.084 | 0.081 | 0.080 | 0.078 | 0.124 |

| | | | | Comparative Example 2 | Comparative Example 3 | Comparative Example 4 | Comparative Example 5 |
|---|---|---|---|---|---|---|---|
| Composition | Base oil | Base oil (a-1) | mass % | — | — | 84.13 | 84.83 |
| | | Base oil (a-2) | mass % | — | — | — | — |
| | | Base oil (a-3) | mass % | 3.70 | 3.70 | 5.50 | 5.50 |
| | | Base oil (a-4) | mass % | 86.48 | 85.93 | — | — |
| | Viscosity index improver | Comb-shaped polymer | mass % | 0.02 | 0.57 | — | 0.57 |
| | | PMA | mass % | — | — | 0.57 | — |
| | Friction modifier | Organic Mo-based compound | mass % | 0.70 | 0.70 | 0.70 | — |
| | Other additive | Additive PKG for engine oil | mass % | 9.10 | 9.10 | 9.10 | 9.10 |
| | — | Total | mass % | 100.00 | 100.00 | 100.00 | 100.00 |
| | Content of base oil (a-1) on the basis of the whole amount (100% by mass) of the base oil | | mass % | 0 | 0 | 93.9 | 93.9 |

TABLE 1-continued

| | | | | | | |
|---|---|---|---|---|---|---|
| | Content of base oil (a-2) based on 100 parts by mass of base oil (a-1) | parts by mass | — | — | — | — |
| | Content of Mo atom | ppm by mass | 700 | 700 | 700 | — |
| Various physical properties | Kinematic viscosity at 40° C. | $mm^2/s$ | 22.04 | 22.69 | 20.49 | 18.54 |
| | Kinematic viscosity at 50° C. | $mm^2/s$ | 15.73 | 16.39 | 15.06 | 13.63 |
| | Kinematic viscosity at 100° C. | $mm^2/s$ | 4.73 | 5.09 | 4.93 | 4.49 |
| | Viscosity index | — | 138 | 163 | 174 | 164 |
| | HTHS viscosity at 150° C. | mPa · s | 1.7 | 1.9 | 1.8 | 1.7 |
| | HTHS viscosity at 50° C. | mPa · s | 14.2 | 14.6 | 12.8 | 12.1 |
| | NOACK value (250° C., 1 h) | mass % | 14.1 | 14.5 | 14.3 | 14.7 |
| | Coefficient of friction (HFRR tester) | — | 0.078 | 0.079 | 0.080 | 0.118 |

The lubricating oil compositions prepared in Examples 1 to 4 brought the results that the HTHS viscosity ($H_{50}$) at 50° C. is small, and the fuel consumption reducing properties in the low-temperature environment are excellent, while achieving low evaporativity. In addition, the value of the coefficient of friction is low, and the friction reducing effect by blending the organic molybdenum-based compound is thoroughly revealed.

On the other hand, the lubricating oil compositions of Comparative Examples 1 and 5 are high in the coefficient of friction at 80° C., and hence, it may be considered that the fuel consumption reducing properties in the practical use temperature area of an engine oil are inferior.

In addition, the lubricating oil compositions of Comparative Examples 2 to 4 are high in the HTHS viscosity ($H_{50}$) at 50° C. as compared with those of Examples 1 to 4, and hence, it may be considered that the fuel consumption reducing properties in the low-temperature environment are inferior.

REFERENCE SIGNS LIST

1: Sliding mechanism
2: Block
2*a*: Piston travel path
2*b*: Crank shaft housing
4: Piston
6, 8: Piston ring
10: Crank shaft
12: Liner

The invention claimed is:

1. A lubricating oil composition, comprising:

a base oil (A) comprising an olefin-based polymer (A1) and an ether compound (A2);

a viscosity index improver (B) comprising a comb-shaped polymer (B1); and an organic molybdenum-based compound (C), wherein the ether compound (A2) has formula (1):

$$R^1—O—R^2 \quad (1)$$

$R^1$ and $R^2$ each independently being an alkyl group having 6 to 22 carbon atoms;

wherein the ether compound (A2) is present in a range of from 30 to 300 parts by mass, based on 100 parts by mass of the olefin-based polymer (A1);.

wherein the comb-shaped polymer (B1) is present in 0.30% by mass or more, based on total lubricating oil composition mass;

wherein the olefin-based polymer (A1) satisfies the (A1-i) to (A1-v)

(A1-i): an area ratio of a peak derived from a hydride (A11) of a decene trimer is 80% or more relative to 100% of a total area of peaks derived from the olefin-based polymer (A1) detected in a chromatogram on performing chromatography analysis, (A1-ii): a kinematic viscosity at 40° C. is 16.0 $mm^2/s$ or less, (A1-iii): a kinematic viscosity at 100° C. is in a range of from 3.0 to 4.0 $mm^2/s$, (A1-iv): a flash point is 220° C. or higher, and (A1-v): a pour point is −30° C. or lower; and wherein the lubricating oil composition satisfies (I) to (IV)

(I): an HTHS viscosity (H150) at 150° C. is in a range of 1.5 to less than 2.5 mPa·s, (II): an HTHS viscosity (H50) at 50° C. is 11.4 mPa·s or less, (III): a NOACK value is 15.0% by mass or less, and (IV): a coefficient of friction is 0.081 or less.

2. The composition of claim 1, wherein, in the ether compound (A2)

$R^1$ and $R^2$ are each independently an alkyl group having 8 to 20 carbon atoms.

3. The composition of claim 1, wherein the ether compound (A2) is of formula (2):

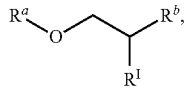

(2)

wherein $R^a$ is a linear alkyl group haying 6 to 22 carbon atoms, and $R^b$ and $R^c$ are each independently a linear alkyl group, and a total carbon number of $R^b$ and $R^c$ is in a range of from 4 to 20.

4. The composition of claim 1, wherein the ether compound (A2) is present in a range of from 80 to 280 parts by mass, based on 100 parts by mass of the olefin-based polymer (A1).

5. The composition of claim 1, wherein the comb-shaped polymer (B1) is a polymer having at least a structural unit (X1) derived from a macromonomer (x1) having a number average molecular weight of 300 or more, and wherein the structural unit (X1) is present in a range of from 0.1 to less than 10 mol %, based on all structural units of the comb-shaped polymer (B1).

6. The composition of claim 1, having a kinematic viscosity at 50° C. in a range of from 5.0 to 14.7 $mm^2/s$.

7. An internal combustion engine, comprising:

a sliding mechanism comprising a piston ring, a liner, and the lubricating oil composition of claim 1.

8. A method for lubricating an internal combustion engine having a sliding mechanism equipped with a piston ring and a liner, the method comprising:

lubricating the piston ring and the liner with the lubricating oil composition of claim 1.

9. The composition of claim 1, wherein the ether compound (A2) is present in a range of from more than 33 to 300 parts by mass, based on 100 parts by mass of the olefin-based polymer (A1).

10. The composition of claim 1, wherein, in the ether compound (A2), one of $R^1$ and $R^2$ is an alkyl group comprising 6 to 14 carbon atoms and the other is an alkyl group comprising 15 to 22 carbon atoms.

11. The composition of claim 1, wherein, in the ether compound (A2), one of $R^1$ and $R^2$ is an alkyl group comprising 6 to 10 carbon atoms and the other is an alkyl group comprising 18 to 22 carbon atoms.

12. The composition of claim 1, wherein the ether compound (A2) has a total carbon number of $R^1$ and $R^2$ in a range of from 24 to 36.

13. The composition of claim 1, wherein the ether compound (A2) has a total carbon number of $R^1$ and $R^2$ in a range of from 26 to 34.

14. The composition of claim 5, wherein the number average molecular weight (Mn) of the macromonomer (x1) is in a range from 2,000 to 100,000.

15. The composition of claim 1, wherein the base oil (A) further comprises (A3) a poly-α-olefin oligomer.

16. The composition of claim 1, having a kinematic viscosity at 40° C. in a range of from 15.65 to 17.72 $mm^2/s$, having a kinematic viscosity at 100° C. in a range of from 3.5 to 6.0 $mm^2/s$, and having a viscosity index in a range of from 192 to 246.

17. The composition of claim 16, wherein, relative to total composition mass, in mass percent, the olefin-based polymer(s) (A1) is present in a range of from 20 to less than 84.13 mass %, the olefin-based polymer(s) (A1) anand the ether compound(s) (A2), together, are present in a range of from 25 to 97 mass %, a poly-α-olefin oligomer(s) (A3) is present n a range of from 0 to 5 mass %.

18. The composition of claim 17, wherein the base oil (A) comprises no further components than at least one of the olefin-based polymer (A1), at least one of the ether compound (A2), and at least one of the poly-α-olefin oligomer (A3).

* * * * *